US006330402B1

(12) United States Patent
Sakurai et al.

(10) Patent No.: US 6,330,402 B1
(45) Date of Patent: Dec. 11, 2001

(54) DEVELOPER AMOUNT INDICATING METHOD, ELECTROPHOTOGRAPHIC IMAGE FORMING APPARATUS AND PROCESS CARTRIDGE

(75) Inventors: Kazushige Sakurai, Mishima; Isao Ikemoto, Kashiwa; Kazushi Watanabe, Mishima; Toshiyuki Karakama, Shizuoka-ken; Hideki Matsumoto, Mishima, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/613,280

(22) Filed: Jul. 10, 2000

(30) Foreign Application Priority Data

Jul. 13, 1999 (JP) ..... 11-199626
Jun. 23, 2000 (JP) ..... 12-190317

(51) Int. Cl.[7] ..... G03G 15/00; G03G 15/08
(52) U.S. Cl. ..... 399/12; 399/27; 399/111
(58) Field of Search ..... 399/12, 24, 25, 399/27, 29, 38, 81, 111; 430/120

(56) References Cited

U.S. PATENT DOCUMENTS

| | | | |
|---|---|---|---|
| 5,095,335 | 3/1992 | Watanabe et al. | 399/111 |
| 5,151,734 | 9/1992 | Tsuda et al. | 399/111 |
| 5,208,634 | 5/1993 | Ikemoto et al. | 399/111 |
| 5,223,893 | 6/1993 | Ikemoto et al. | 399/111 |
| 5,294,960 | 3/1994 | Nomura et al. | 399/113 |
| 5,331,372 | 7/1994 | Tsuda et al. | 399/114 |
| 5,345,294 | 9/1994 | Nomura et al. | 399/90 |
| 5,404,198 | 4/1995 | Noda et al. | 399/107 |
| 5,455,665 | 10/1995 | Baba et al. | 399/358 |
| 5,463,446 | 10/1995 | Watanabe et al. | 399/111 |
| 5,465,136 | 11/1995 | Watanabe et al. | 399/111 |
| 5,470,635 | 11/1995 | Shirai et al. | 428/131 |
| 5,475,470 | 12/1995 | Sasago et al. | 399/111 |
| 5,475,471 | 12/1995 | Kisu et al. | 399/115 |
| 5,488,459 | 1/1996 | Tsuda et al. | 399/167 |
| 5,500,714 | 3/1996 | Yashiro et al. | 399/111 |
| 5,510,878 | 4/1996 | Noda et al. | 399/111 |
| 5,534,344 | 7/1996 | Kisu et al. | 428/323 |
| 5,541,711 | 7/1996 | Kisu et al. | 399/176 |
| 5,543,898 | 8/1996 | Shishido et al. | 399/111 |
| 5,561,504 | 10/1996 | Watanabe et al. | 399/111 |
| 5,581,325 | 12/1996 | Tsuda et al. | 399/116 |
| 5,583,613 | 12/1996 | Kobayashi et al. | 399/111 |
| 5,585,895 | 12/1996 | Yashiro et al. | 399/103 |
| 5,602,623 | 2/1997 | Nishibata et al. | 399/111 |
| 5,608,509 | 3/1997 | Shirai et al. | 399/351 |
| 5,617,579 | 4/1997 | Yashiro et al. | 399/114 |
| 5,623,328 | 4/1997 | Tsuda et al. | 399/111 |
| 5,640,650 | 6/1997 | Watanabe et al. | 399/117 |
| 5,659,847 | 8/1997 | Tsuda et al. | 399/113 |
| 5,669,042 | 9/1997 | Kobayashi et al. | 399/111 |
| 5,689,774 | 11/1997 | Shishido et al. | 399/111 |
| 5,740,499 | 4/1998 | Higeta et al. | 399/105 |
| 5,749,027 | 5/1998 | Ikemoto et al. | 399/113 |
| 5,765,077 | 6/1998 | Sakurai et al. | 399/176 |
| 5,768,658 | 6/1998 | Watanabe et al. | 399/111 |
| 5,768,660 | 6/1998 | Kurihara et al. | 399/111 |
| 5,774,766 | 6/1998 | Karakama et al. | 399/111 |
| 5,790,923 | 8/1998 | Oguma et al. | 399/106 |

(List continued on next page.)

*Primary Examiner*—Sophia S. Chen
(74) *Attorney, Agent, or Firm*—Fitzpatrick, Cella, Harper & Scinto

(57) ABSTRACT

In a developer amount successively indicating method used in an electrophotographic image forming apparatus capable of detachably mounting a plurality of types of cartridges differing in the fill amount of a developer, an indicating portion selected in conformity with the type of one of the plurality of types of cartridges which is mounted in the main body of the electrophotographic image forming apparatus is indicated, and the detected amount of developer in the cartridge mounted in the main body of the electrophotographic image forming apparatus is successively indicated by the use of the indicating portion.

37 Claims, 15 Drawing Sheets

U.S. PATENT DOCUMENTS

| | | | | |
|---|---|---|---|---|
| 5,794,101 | | 8/1998 | Watanabe et al. | 399/103 |
| 5,802,420 | * | 9/1998 | Garr et al. | 399/27 |
| 5,809,374 | | 9/1998 | Tsuda et al. | 399/111 |
| 5,812,909 | | 9/1998 | Oguma et al. | 399/103 |
| 5,828,928 | | 10/1998 | Sasago et al. | 399/111 |
| 5,864,731 | | 1/1999 | Ikemoto et al. | 399/27 |
| 5,878,304 | | 3/1999 | Watanabe et al. | 399/92 |
| 5,878,310 | | 3/1999 | Noda et al. | 399/117 |
| 5,884,124 | | 3/1999 | Karakama et al. | 399/123 |
| 5,890,036 | | 3/1999 | Karakama et al. | 399/119 |
| 5,899,602 | | 5/1999 | Noda et al. | 399/111 |
| 5,903,803 | | 5/1999 | Kawai et al. | 399/116 |
| 5,920,752 | | 7/1999 | Karakama et al. | 399/111 |
| 5,937,237 | | 8/1999 | Nonaka et al. | 399/106 |
| 5,937,242 | | 8/1999 | Yokoyama et al. | 399/114 |
| 5,943,528 | | 8/1999 | Akutsu et al. | 399/110 |
| 5,966,566 | | 10/1999 | Odagawa et al. | 399/109 |
| 5,966,568 | | 10/1999 | Numagami et al. | 399/111 |
| 6,006,058 | | 12/1999 | Watanabe et al. | 399/167 |
| 6,016,413 | | 1/2000 | Yokoyama et al. | 399/113 |
| 6,023,594 | * | 2/2000 | Okiyama et al. | 399/12 |
| 6,029,032 | | 2/2000 | Watanabe et al. | 399/111 |
| 6,032,007 | | 2/2000 | Yamaji et al. | 399/104 |
| 6,058,278 | | 5/2000 | Tsuda et al. | 399/106 |
| 6,070,028 | | 5/2000 | Odagawa et al. | 399/104 |
| 6,075,956 | | 6/2000 | Watanabe et al. | 399/92 |
| 6,075,957 | | 6/2000 | Batori et al. | 399/114 |
| 6,097,908 | | 8/2000 | Uchiyama et al. | 399/111 |
| 6,097,909 | | 8/2000 | Watanabe et al. | 399/111 |
| 6,253,036 | * | 6/2001 | Karakama et al. | 399/27 |

* cited by examiner

DEVELOPER AMOUNT INDICATING METHOD, ELECTROPHOTOGRAPHIC IMAGE FORMING APPARATUS AND PROCESS CARTRIDGE

BACKGROUND OF THE INVENTION

1. Field of the Invention

This invention relates to a developer amount indicating method, an electrophotographic image forming apparatus and a process cartridge.

Here, an electrophotographic image forming apparatus is an apparatus for forming an image on a recording medium by the use of an electrophotographic-image-forming process. It covers, for example, an electrophotographic copier, an electrophotographic printer (such as an LED printer or a laser beam printer), an electrophotographic facsimile apparatus and an electrophotographic word processor.

Also, here, a process cartridge refers to at least one of charging means, developing means and cleaning means as process means and an electrophotographic photosensitive member integrally made into a cartridge, which is detachably mountable to the main body of the electrophotographic image forming apparatus. Or it refers to developing means as process means and an electrophotographic photosensitive member integrally made into a cartridge, which is detachably mountable to the main body of the electrophotographic image forming apparatus.

2. Related Background Art

In an electrophotographic image forming apparatus, there has heretofore been adopted a process cartridge system whereby an electrophotographic photosensitive member and process means acting on the electrophotographic photosensitive member are integrally made into a cartridge which is detachably mountable to the main body of the electrophotographic image forming apparatus. According to this process cartridge system, the maintenance of the apparatus can be done by a user himself without resorting to a serviceman and therefore, the operability of the apparatus can be markedly improved. So, this process cartridge system is widely used in electrophotographic image forming apparatus.

In the image forming apparatus of such a process cartridge type, as a standard for the user to effect the interchange of the process cartridge, there is the function of detecting that the remaining amount of developer in a developer container provided in the process cartridge has assumed a predetermined value or less, and informing the user of it.

Also, in order to improve the convenience to the user, the function of successively detecting the remaining amount of developer and informing the user of the remaining amount of developer by a gauge corresponding to the amount of developer as shown, for example, in FIG. 18 of the accompanying drawings has been put into practical use. In a developer remaining amount indicator 40 shown in FIG. 18, the user is informed of the remaining amount of developer by what portion of an indicating portion (gauge) 42 provided with a scale 42*a* from "Full" to "Empty" is pointed to by a pointer 41 moving in conformity with the remaining amount of developer.

In recent years, a plurality of types of process cartridges differing from one another in the amount of developer filling a developer container have been prepared so that the user can select them. Image forming apparatuses capable of mounting such a plurality of types of process cartridges have been commercialized.

Usually, when the amount of developer in a process cartridge is to be detected, the absolute amount of developer is detected. Therefore, it is conceivable that there is a possibility that a distinction cannot be made between a case where a new process cartridge having a small amount of developer filling a developer container (hereinafter referred to as the "low capacity process cartridge") has been mounted and a case where a process cartridge having a large in the amount of developer filling a developer container (hereinafter referred to as the "high capacity cartridge") that has decreased by consumption has been mounted.

In the image forming apparatus on which such a plurality of types of process cartridges are mounted, when the user is informed of the remaining amount of developer by the conventional gauge system shown in FIG. 18, the following problems can occur. When for example, the position of "Full" is adjusted so as to indicate the fullness of a small developing capacity cartridge, if the high capacity cartridge is mounted, the pointer 41 continues to stay at the position of "Full" in the gauge 42 until the developer is consumed up to an amount corresponding to the fullness of the low capacity cartridge with the developer. Accordingly, the problem occurs that in the meantime, the amount of developer cannot be indicated successively.

Also, when the position of "Full" shown in FIG. 18 is adjusted so as to indicate the fullness of the high capacity cartridge with the developer, if a low capacity cartridge is mounted, it would occur that in spite of the cartridge being new, the pointer 41 points to a position less than the "Full" in the gauge 42.

SUMMARY OF THE INVENTION

It is an object of the present invention to provide a developer amount indicating method, an electrophotographic image forming apparatus and a process cartridge which can comprehensibly indicate the amount of developer.

It is another object of the present invention to provide, in an image forming apparatus capable of mounting a plurality of types of process cartridges differing in the fill amount of developer with respect to a developer containing portion, a developer amount indicating method capable of successively indicating the amount of developer in conformity with the types of the process cartridges, an electrophotographic image forming apparatus using the indicating method, and a process cartridge detachably mountable with respect to the main body of the image forming apparatus.

It is another object of the present invention to provide a developer amount indicating method, an electrophotographic image forming apparatus and a process cartridge capable of successively effecting the indication of the amount of developer comprehensible to an operator even when a plurality of types of process cartridges differing in the fill amount of developer with respect to a developer containing portion are mounted.

It is another object of the present invention to provide, in a plurality of types of process cartridges differing in the fill amount of developer in a developer containing portion, a developer amount indicating method, an electrophotographic image forming apparatus and a process cartridge capable of successively indicating the remaining amount of developer from "Full" to "Empty".

It is another object of the present invention to provide a developer amount successively indicating method used in an electrophotographic image forming apparatus capable of detachably mounting a plurality of types of cartridges differing in the fill amount of developer, wherein an indicating portion selected in conformity with the type of one of the plurality of kinds of cartridges which is mounted in the main body of the electrophotographic image forming apparatus is indicated, and the detected amount of developer in the cartridge mounted in the main body of the electrophotographic image forming apparatus is successively indicated by the use of the indicating portion, an electrophotographic image forming apparatus using the indicating method, and a process cartridge detachably mounted in the electrophotographic image forming apparatus.

It is another object of the present invention to provide a developer amount successively indicating method used in an electrophotographic image forming apparatus capable of detachably mounting a plurality of types of cartridges differing in the fill amount of developer, wherein indicating portions conforming to the type of the cartridges are indicated correspondingly to the types of the cartridges, and the detected amount of developer in the cartridge mounted in the main body of the electrophotographic image forming apparatus is successively indicated by the use of the indicated indicating portions, an electrophotographic image forming apparatus using the indicating method, and a process cartridge detachably mountable in the electrophotographic image forming apparatus.

These and other objects, features and advantages of the present invention will become more apparent upon consideration of the following description of the preferred embodiments of the present invention taken in conjunction with the accompanying drawings.

DESCRIPTION OF THE PREFERRED EMBODIMENTS

A developer amount indicating method, an electrophotographic image forming apparatus and a process cartridge according to the present invention will hereinafter be described in greater detail with reference to the drawings.

Embodiments which will hereinafter be described relate to a developer amount indicating method of successively detecting the remaining amount of developer in a developer container in the main body of an image forming apparatus capable of mounting a plurality of types of process cartridges differing in the fill amount of developer with respect to the developer container, and successively indicating the amount of developer in conformity with the types of the process cartridges, an electrophotographic image forming apparatus using the indicating method, and further a process cartridge detachably mountable with respect to the image forming apparatus.

Embodiment 1

Figure 1:
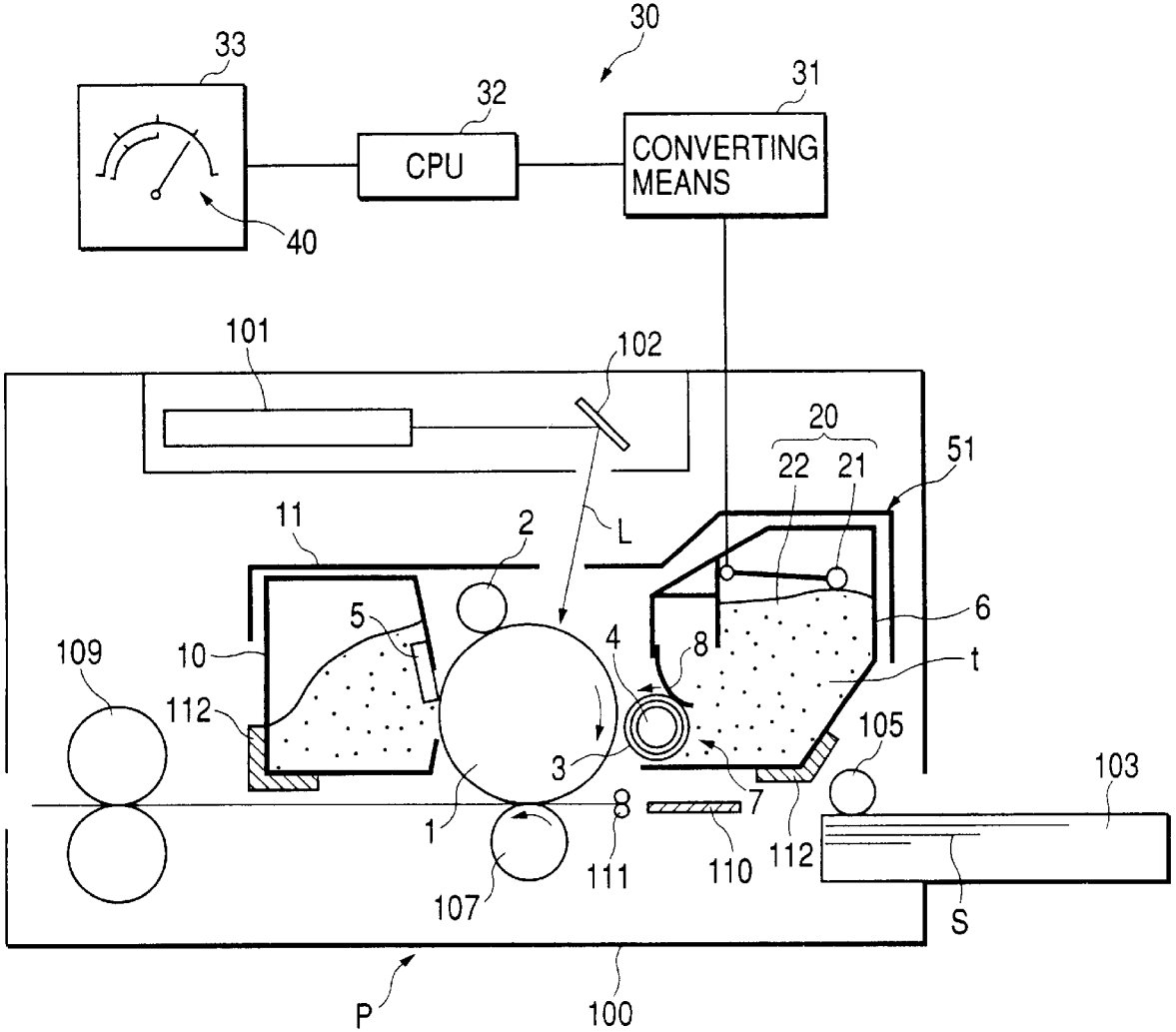
FIG. 1 schematically shows the construction of an embodiment of an electrophotographic image forming apparatus according to the present invention.

Reference is first had to FIG. 1 to describe an embodiment of an electrophotographic image forming apparatus capable of mounting a process cartridge using an embodiment of the present invention. In the present embodiment, the electrophotographic image forming apparatus is a laser beam printer for forming an image on a recording medium S such as recording paper, an OHP sheet, or cloth by the electrophotographic image forming process. Particularly, FIG. 1 is a schematic cross-sectional view showing a state in which a process cartridge 51, which will be described later, is mounted in the main body 100 of the electrophotographic image forming apparatus.

As shown in FIG. 1, the electrophotographic image forming apparatus P (image forming apparatus) of the present embodiment has a drum-shaped electrophotographic photosensitive member (photosensitive drum) 1 rotatable in the direction indicated by the arrow, and an electrostatic latent image is formed on the surface of this photosensitive drum 1 by electrostatic latent image forming means. That is, the surface of the photosensitive drum 1 is uniformly charged in advance by a charging roller 2 as charging means. Subsequently, a laser beam L modulated in conformity with an image signal is outputted from a scanner unit 101 as exposing means having a laser and a polygon mirror correcting system lens. This lens beam L is reflected by a turn-back mirror 102 and applied onto the photosensitive drum 1, thereby forming an electrostatic latent image conforming to the application of the laser beam L on the photosensitive drum 1. This electrostatic latent image is thereafter developed into a visible image, i.e., a toner image, by developing means 7.

That is, the developing means 7 has a developing roller 3 containing a stationary magnet 4 therein, and an elastic blade 8 for regulating the layer thickness of a developer carried on this developing roller 3. Also, a developer container 6 as a developer containing portion is provided adjacent to the developing means 7. The developer stored in this developer container 6 is charged and borne and conveyed on the peripheral surface of the developing roller 3 with the rotation of this developing roller 3 indicated by the arrow. Then, the developer adhering to the peripheral surface of the developing roller 3 has its layer thickness regulated by the elastic blade 8 and becomes a developer layer capable of developing a latent image. The electrostatic latent image on the photosensitive drum 1 is developed by the developer shifting from the developer layer conveyed with the rotation of the developing roller 3. Usually, a developing bias voltage comprising a DC voltage superimposed on an AC voltage is applied to the developing roller 3.

On the other hand, the recording medium S contained in a recording medium containing cassette 103 is fed out by a recording medium supplying roller 105, conveying means 110, etc. in synchronism with the formation of the electrostatic latent image on the photosensitive drum 1. It is further conveyed to the opposed portion (transferring portion) of roller-shaped transferring means, i.e., a transferring roller 107, and the photosensitive drum 1 by a pair of registration rollers 111 in synchronism with the leading end of the toner image formed on the photosensitive drum 1. Then, the toner image is transferred onto the recording medium S by the transferring roller 107.

The recording mediums S onto which the toner image has been transferred is conveyed to a fixing device 109, where the toner image is fixed on the recording medium S by heat and pressure and becomes a permanent image.

Thereafter, the recording medium S on which the toner image is formed is discharged out of the image forming apparatus. Also, any developer residual on the photosensitive drum 1 is removed by cleaning means 5, and is contained in a removed developer container 10. The photosensitive drum 1 is then repetitively used for image formation.

As shown in FIG. 1, in the present embodiment, the photosensitive drum 1, the charging means (charging roller) 2, the developing means 7 provided with the developing roller 3 and the elastic blade 8, and the cleaning means 5 as process means acting on the photosensitive drum 1, and further the developer container 6 as the developer containing portion formed integrally with the developing means 7, and the removed developer container 10 formed integrally with the cleaning means 5 are integrally coupled together by a frame member 11 and are thereby made into a process cartridge 51.

Also, the process cartridge 51 is removably mounted in the main body 100 of the image forming apparatus through mounting means 112 as a mounting portion provided in the main body 100 of the image forming apparatus. As previously described, the process cartridge 51 can be interchanged by a user himself when the developer stored in the developer container 6 has been depleted or when the photosensitive drum 1 has come to the end of its life.

According to the present embodiment, the image forming apparatus has a developer amount detecting device for successively detecting the remaining amount of developer in the developer container 6. That is, the process cartridge 51 is provided with developer amount detecting means 20 for successively detecting the amount of developer remaining in the developer container 6, and the main body 100 of the image forming apparatus is provided with a controlling portion 30 for processing an electrical signal, i.e., developer amount information, outputted by the developer amount detecting means 20 in conformity with the amount of developer in the developer container 6.

According to the present embodiment, the controlling portion 30 has converting means 31 for converting the developer amount information in the developer container 6 obtained by the developer amount detecting means 20 in the present embodiment, which will be described later, into an electrical signal, and a CPU (central processing unit) 32 for causing the remaining amount of developer to be successively indicated on developer amount indicating means 33 on the basis of that signal as will be described later.

As the developer amount detecting means 20, use can be made of any means that can successively detect the amount of developer remaining in the developer container 6.

In the present embodiment, as shown in FIG. 1, as the developer amount detecting means 20, use is made of a method of detecting the position of contacting means 21 disposed on the surface of the upper portion of the developer contained in the developer container 6 by an arm 22 which is following means coupled to the contacting means 21. That is, with the consumption of the developer, the contacting means 21 is always disposed on the surface of the upper portion of the developer by gravity, and the position of the contacting means 21 is detected through the arm 22 pivotally moved, following the movement of the contacting means 21.

A description will now be provided of a method of successively detecting the amount of developer in the developer container 6 and a method of indicating it, in the present embodiment.

Figure 2A:
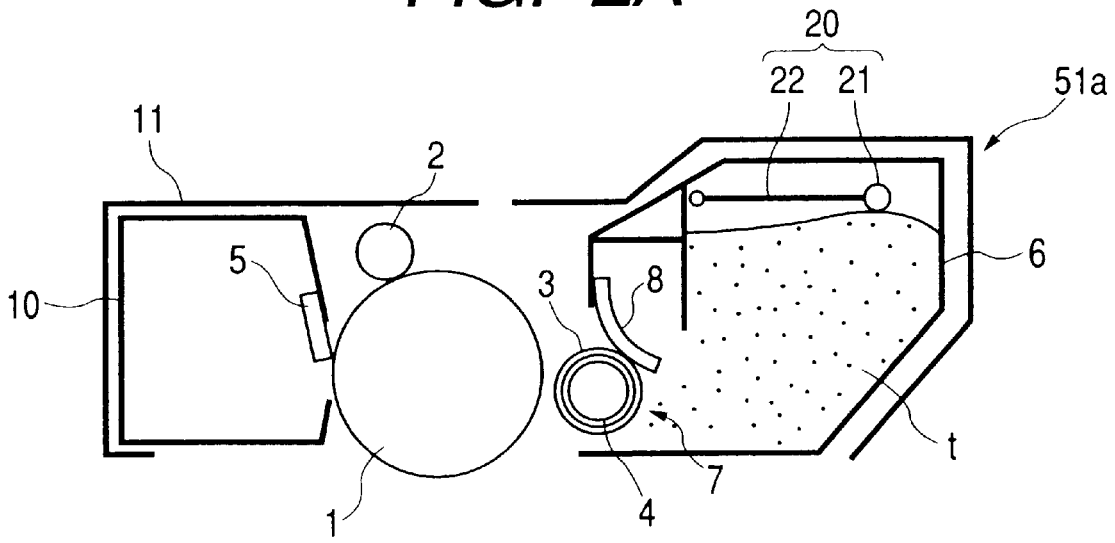
FIG. 2A schematically shows the construction of an example of a high capacity process cartridge mountable in the electrophotographic image forming apparatus according to the present invention.
Figure 2B:
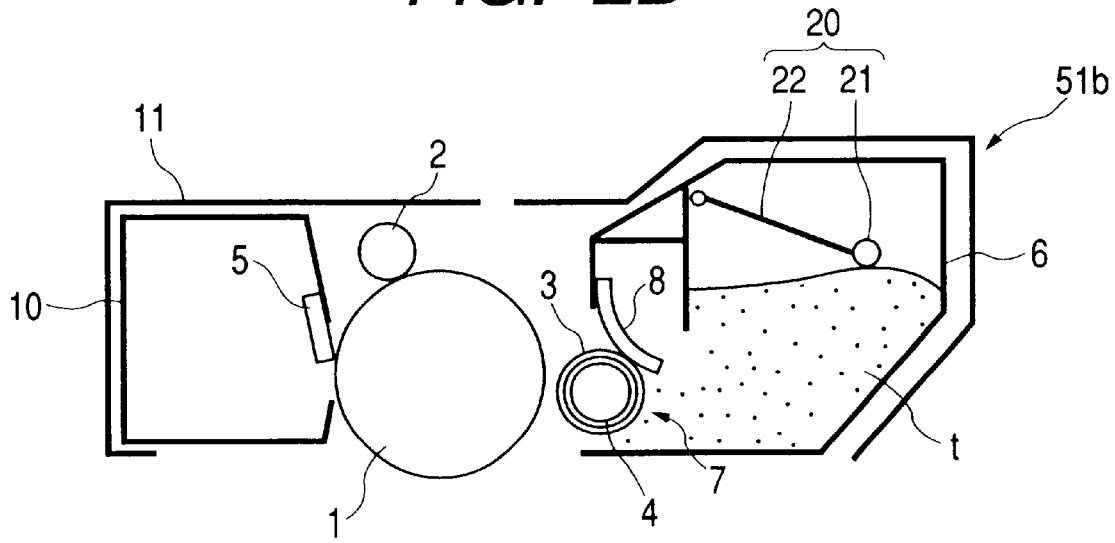
FIG. 2B schematically shows the construction of an example of a low capacity process cartridge mountable in the electrophotographic image forming apparatus according to the present invention.

In the present embodiment, a description will be provided of cases where, as shown in FIGS. 2A and 2B, two types of process cartridges, i.e., a high capacity cartridge 51*a* and a low capacity cartridge 51*b*, are mounted in the main body 100 of the image forming apparatus as a plurality of types of process cartridges differing in the fill amount of developer stored in the developer container 6.

While the high capacity and low capacity process cartridges 51*a* and 51*b* are similar in construction to each other with the exception that they differ in the fill amount of developer stored in the developer container 6, i.e., the fill amount when they are new, the present invention is not restricted thereto, but the shape or the like of the housing of the developer container 6 may be changed as required.

In the present embodiment, the amounts of developer stored in the respective process cartridges 51*a* and 51*b* when they are new are 500 g for the high capacity cartridge 51*a* and 300 g for the low capacity cartridge 51*b*. Also, the construction and setting of the developer amount detecting means 20 are entirely the same for both process cartridges 51*a* and 51*b*.

Figure 3:
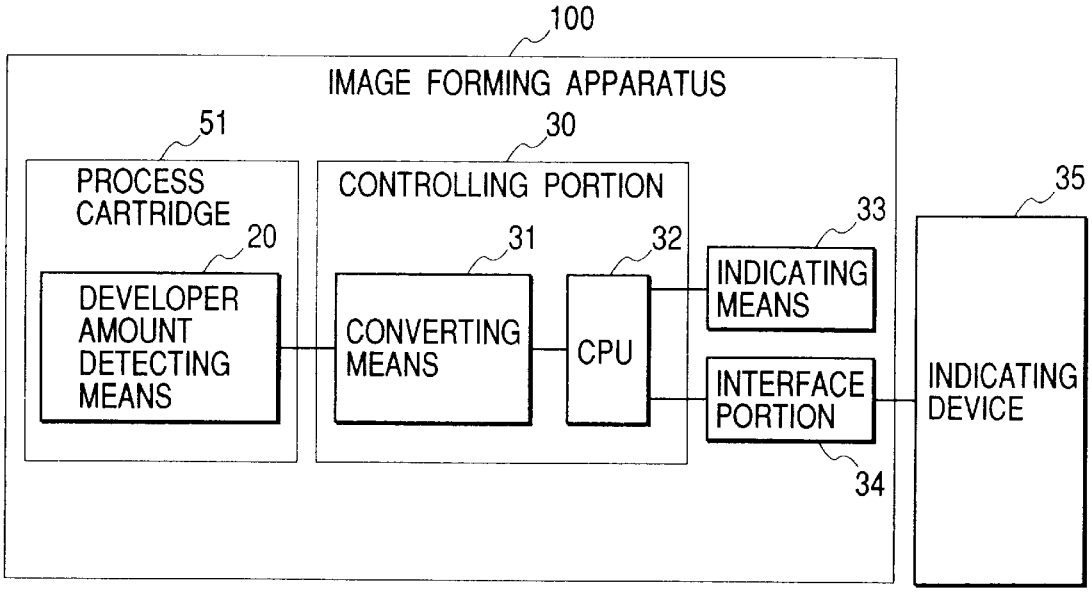
FIG. 3 is a block diagram of an embodiment of the electrophotographic image forming apparatus according to the present invention.

FIG. 3 shows a block diagram of the present embodiment.

According to the present embodiment, the position of the contacting means 21 detected by the arm 22 of the developer amount detecting means 20 is converted into an electrical signal by converting means 31 and the electrical signal is sent to a CPU 32. Then, a calculation is effected by the CPU 32 so that the electrical signal may become a signal conforming to the amount of developer in the developer container 6, and a signal for indicating the remaining amount of developer is sent to developer amount indicating means 33.

Also, as shown in FIG. 3, the signal of the CPU 32 may be sent to an outside indicating device 35 through an interface portion 34 and indicated on the screen of the outside device. As a specific example of the outside device, in an image forming apparatus connected, for example, to a personal computer network, mention may be made of the screen or the like of a host computer connected to the image forming apparatus.

By doing so, the operator can know the remaining amount of developer while operating the host computer.

Figure 4:
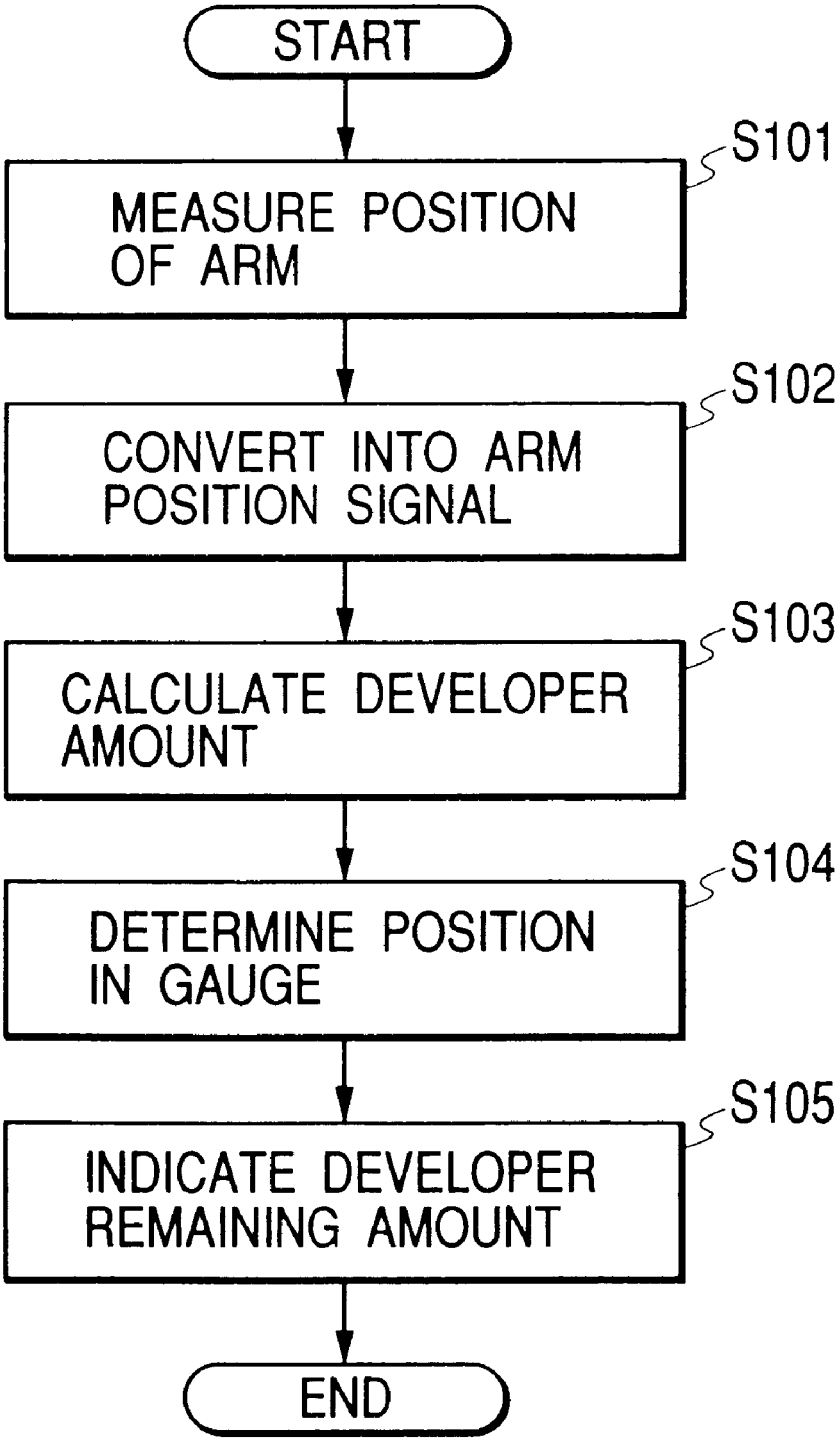
FIG. 4 is a flowchart of an embodiment of the developer amount indicating operation of the present invention.

FIG. 4 shows a flowchart of the remaining amount indicating operation in the present embodiment.

The operation of the present embodiment will hereinafter be described with reference to FIG. 4.

The position of the arm 22 is first detected by the developer amount detecting means 20 (S101). Next, the position of the arm 22 is converted into a position signal by the converting means 31 (S102). The position signal is sent to the CPU 32, by which the remaining amount of developer is calculated (S103). The position in a gauge indicated by a pointer is determined in conformity with the amount of developer thus found (S104). Thereafter, the remaining amount of developer is indicated on the indicating means (S105).

Figure 5:
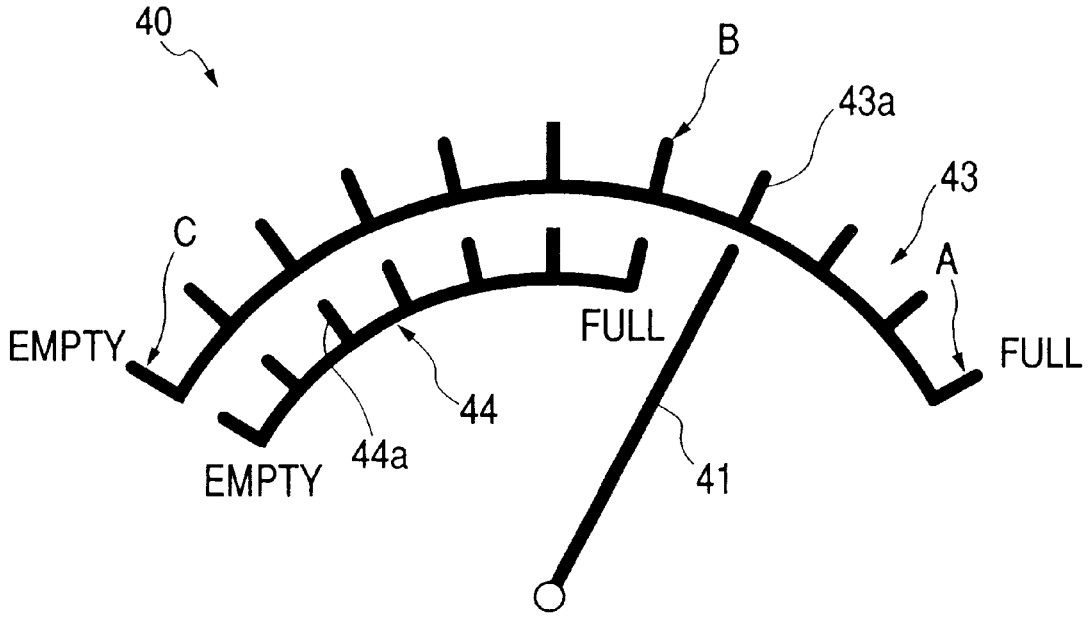
FIG. 5 shows an embodiment of a developer amount indicating method according to the present invention.

FIG. 5 shows an example of the developer remaining amount indication 40 on the developer amount indicating means 33 in the present embodiment. According to the present embodiment, there are indicated two types of gauges (indicating portions) provided with graduations 43*a* for high capacity and graduations 44*a* for low capacity, respectively, i.e., a gauge 43 for high capacity and a gauge 44 for low capacity, in order to indicate the remaining amounts of developer in the developer containers 6 of the high capacity cartridge 51*a* and the low capacity cartridge 51*b* as a plurality of types of process cartridges differing in the fill amount of developer in the developer container 6.

The user reads the graduations 43*a* of the gauge 43 for high capacity when the process cartridge mounted in the main body 100 of the image forming apparatus is the high capacity cartridge 51*a*. Also, the user reads the graduations 44*a* of the gauge 44 for low capacity when the low capacity cartridge 51*b* is mounted.

As shown in FIG. 5, a pointer 41 moves in conformity with the movement of the surface of the upper portion of the developer in the developer container 6. The pointer 41 is controlled as follows by the CPU 32. First, the pointer 41 points to a portion A when the amount of developer is 500 g, and points to a portion B when the amount of developer is 300 g. Further, the pointer 41 points to a portion C when the developer is absent.

Accordingly, in a case where the high capacity cartridge 51*a* is mounted in the main body 100 of the image forming apparatus, when the cartridge is new, the pointer 41 is indicated at the position of "Full" in the gauge 43 for high capacity, and can successively indicate the amount of developer until the developer runs short and the pointer 41 points to the position of "Empty".

Also, in a case where the low capacity cartridge 51*b* is mounted in the main body 100 of the image forming apparatus, when the cartridge is new, the pointer 41 is indicated at the position of "Full" in the gauge 44 for low capacity, and can successively indicate the amount of developer until the developer runs short and the pointer 41 points to the position of "Empty".

Figure 6:
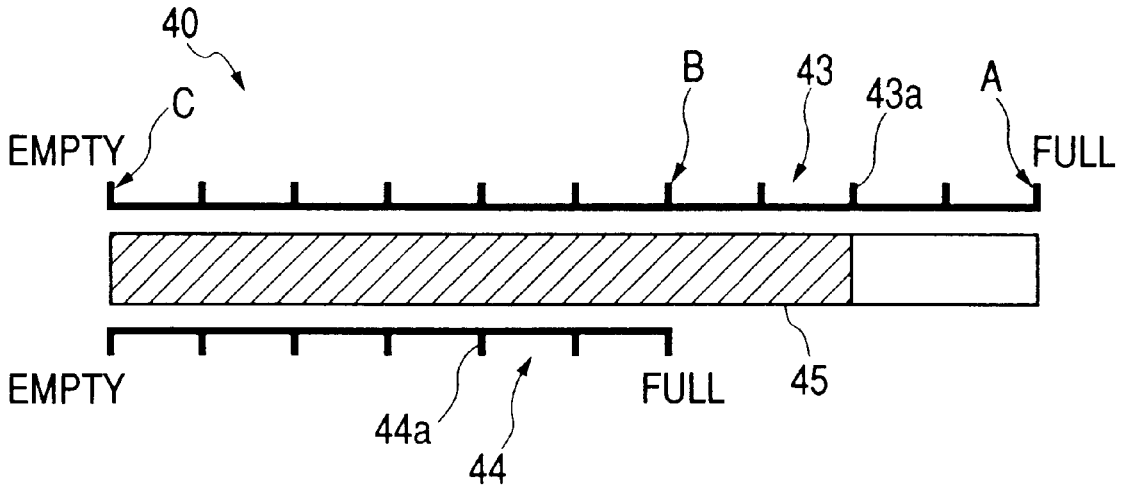
FIG. 6 shows a modification of the developer amount indicating method shown in FIG. 5.

FIG. 6 shows a modification of the present embodiment. In the embodiment shown in FIG. 6, instead of the pointer 41 in FIG. 5, a bar 45 points to positions in gauges 43 and 44 to thereby indicate the amounts of developer in the developer containers 6. Again in such an indicating method, the plurality of types of gauges 43 and 44 (graduations 43*a* and 44*a*) are indicated in conformity with the types of the process cartridges 51 and therefore, as in the case of the indicating method shown in FIG. 5, the effect of the present invention can be obtained.

As described above, according to the present embodiment, even when the plurality of types of process cartridges 51*a* and 51*b* differing in the fill amount of developer in the developer container 6 are mounted, it is possible to effect the indication of the amount of developer which is comprehensible to the user.

Embodiment 2

Figure 7:
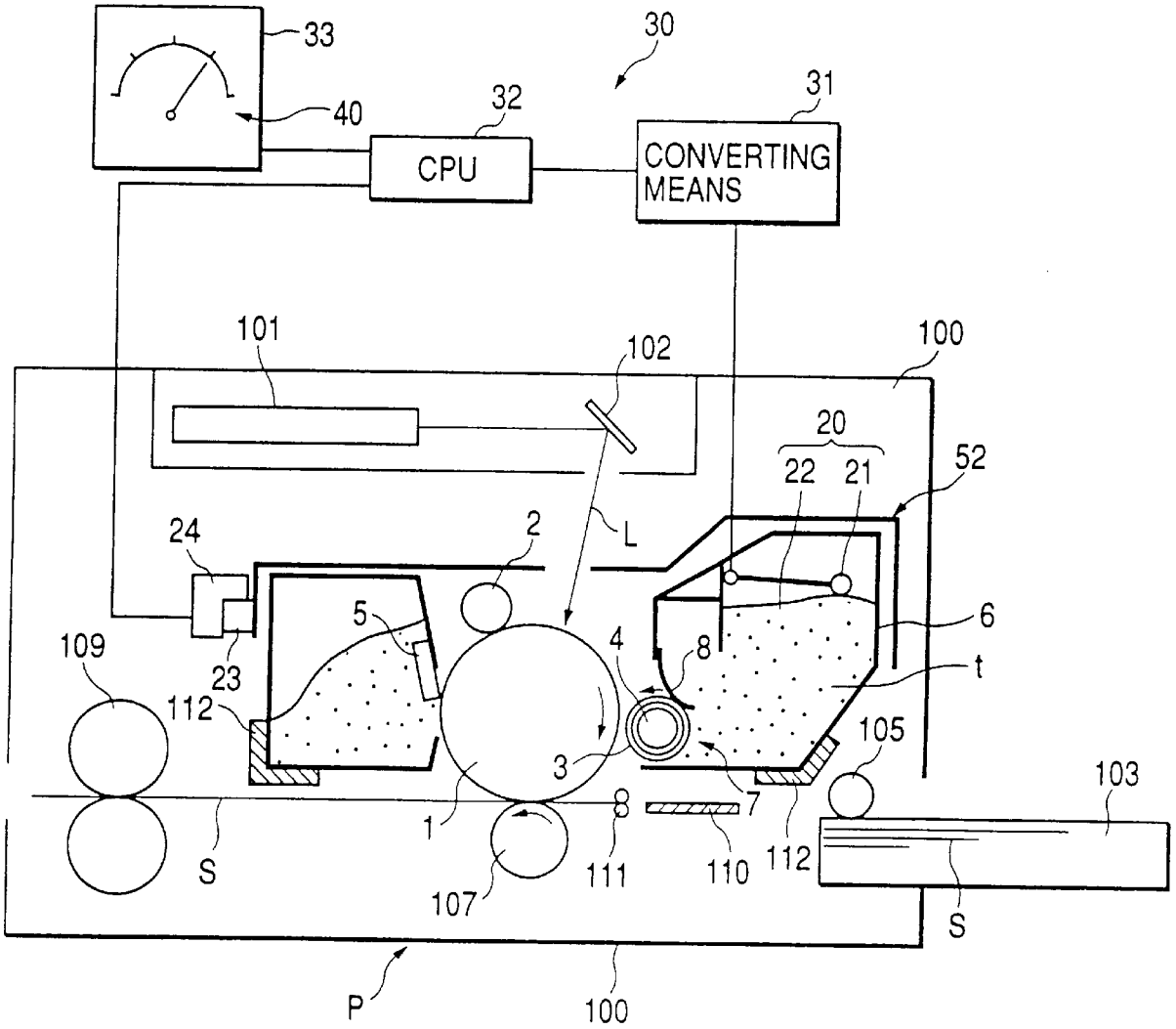
FIG. 7 schematically shows the construction of another embodiment of the electrophotographic image forming apparatus according to the present invention.

FIG. 7 schematically shows the construction of another embodiment of the image forming apparatus capable of detachably mounting a process cartridge, and shows a state in which the process cartridge 52 of the present embodiment is mounted. The constructions of the process cartridge 52 and the image forming apparatus in the present embodiment are basically similar to those of Embodiment 1 and therefore, members similar in construction and function to those in Embodiment 1 are given similar reference numerals and need not be described in detail.

According to the present embodiment, the process cartridge 52 has, in addition to the construction of the process cartridges 51 described in Embodiment 1, a discriminating member 23 as an informing portion for indicating the type of the process cartridge 52 by the fill amount of developer contained in the developer container 6, i.e., the fill amount when the process cartridge 52 is new. Also, the main body 100 of the image forming apparatus is provided with type detecting means 24 as a detecting portion. This type detecting means 24, in a state in which the process cartridge 52 is mounted in the main body 100 of the image forming apparatus, reads the fill amount of developer in the developer container 6 indicating by the discriminating member 23 provided on the process cartridge 52, i.e., information regarding the type of the process cartridge 52.

According to the present embodiment, the indication of the remaining amount of developer on the developer amount indicating means 33 is changed over in conformity with the fill amount of developer in the process cartridge 52 read by the type detecting means 24.

That is, as shown in FIG. 7, the type detecting means 24 provided in the main body 100 of the image forming apparatus reads the content of the discriminating member 23 provided on the process cartridge 52, and sends to the CPU 32 information indicating that the process cartridge is a high capacity cartridge 52*a* or a low capacity cartridge 52*b*, for example, in the present embodiment, as the information regarding the fill amount of developer in the developer container 6. The CPU 32 discriminates the type of the mounted process cartridge 52 by the information sent thereto.

Figure 8:
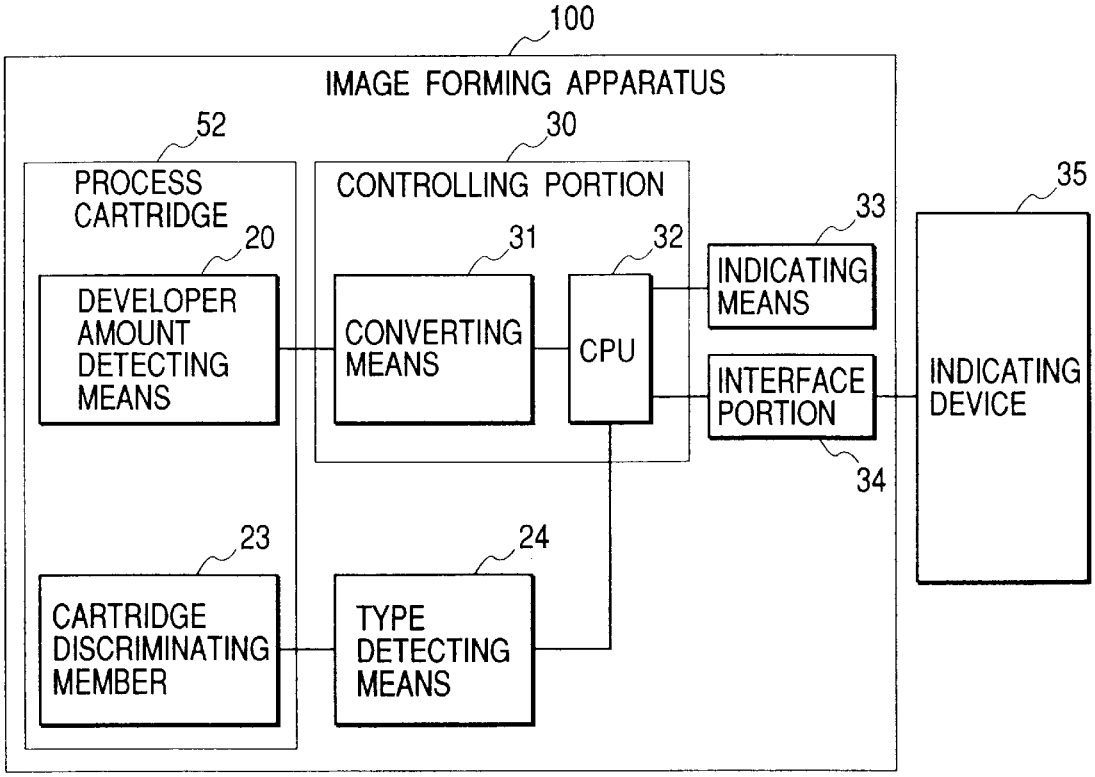
FIG. 8 is a block diagram of another embodiment of the electrophotographic image forming apparatus according to the present invention.

FIG. 8 shows a block diagram of Embodiment 2.

As in Embodiment 1, the developer amount detecting means 20 as a detecting signal outputting portion provided in the process cartridge 52 detects the amount of developer and delivers the developer amount information to the converting means 31 provided in the main body 100 of the image forming apparatus. This information is then converted into an electrical signal by the converting means 31, whereafter the electrical signal is inputted to the CPU 32. Also, the cartridge discrimination information of the cartridge discriminating member 23 provided on the process cartridge sends information indicative of the type of the cartridge to the CPU 32 through the type detecting means 24. The CPU 32 sends the signal of the developer amount indication 40 from both of the detection signal of the amount of developer and the signal indicative of the type of the cartridge 52 to the developer amount indicating means 33.

Also, as in Embodiment 1, the signal of the developer amount indication 40, as shown in FIG. 8, may be sent to the outside indicating device 35 through the interface portion 34 and indicated on the screen of the outside indicating device.

As specific examples of the discriminating member 23 provided on the process cartridge 52 and the type detecting means 24 provided in the main body 100 of the image forming apparatus, mention may be made of a construction in which projections provided on the discriminating member 23, whose number and presence are varied by the type of the process cartridge 52, push a switch provided on the type detecting means 24. Besides this, use can be made of conventional means, such as the reading of an optical signal, or providing an electrical memory, as the discriminating member 23 on the process cartridge 52, and the type detecting means 24 in the main body 100 of the image forming apparatus reading information stored in this memory.

Figure 9:
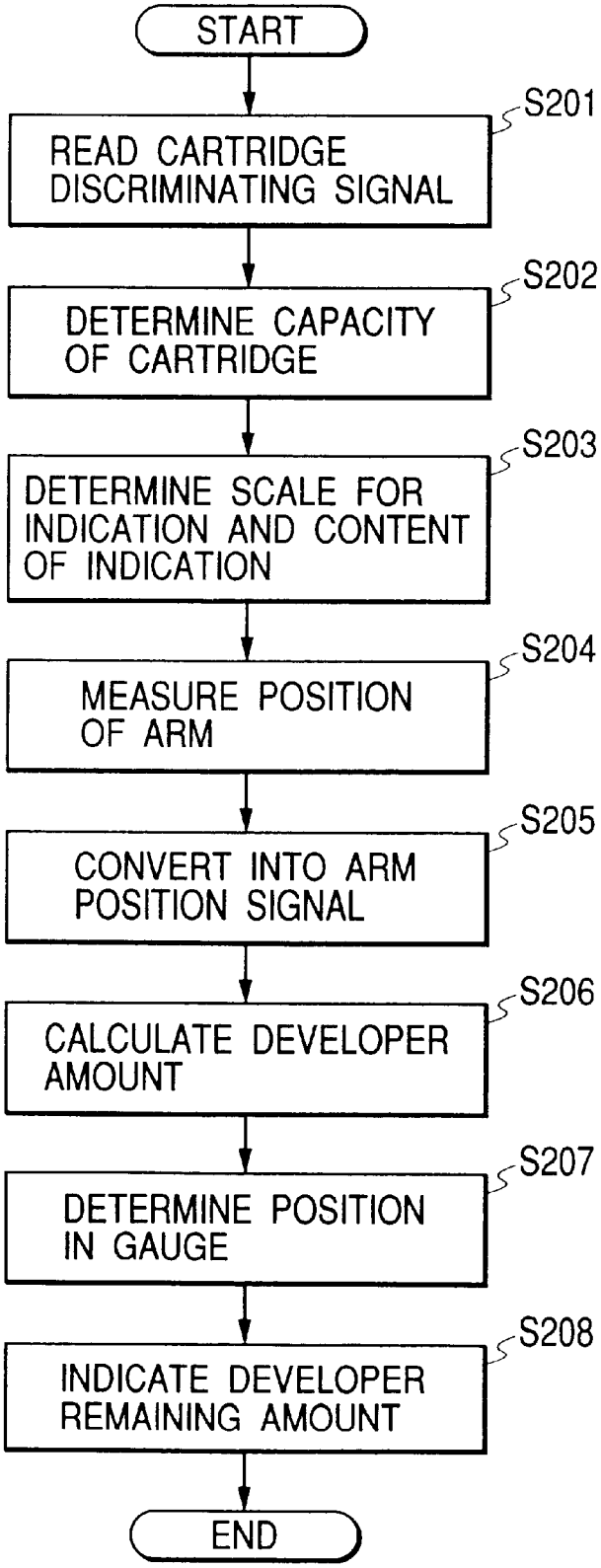
FIG. 9 is a flowchart of another embodiment of the developer amount indicating operation of the present invention.

FIG. 9 shows a flowchart of the remaining amount indicating operation in Embodiment 2.

The operation of Embodiment 2 will hereinafter be described with reference to FIG. 9.

A cartridge discriminating signal is first read (S201), and the capacity of the cartridge being mounted is determined (S202). After the capacity has been determined, the graduations for the indication of the remaining amount conforming to the capacity and the content of the indication are determined (S203).

Next, the position of the arm 22 is detected by the developer amount detecting means 20 (S204). The position of the arm 22 is converted into a position signal by the converting means 31 (S205). The position signal is sent to the CPU 32, by which the remaining amount of developer is calculated (S206). The position in the gauge indicated by the pointer is determined in conformity with the amount of developer thus found (S207). Thereafter, the graduations for the indication of the remaining amount and the content of the indication determined at S203 and the position in the gauge determined at S207 are combined together and the remaining amount of developer is indicated on the indicating means (S208).

Figure 10A:
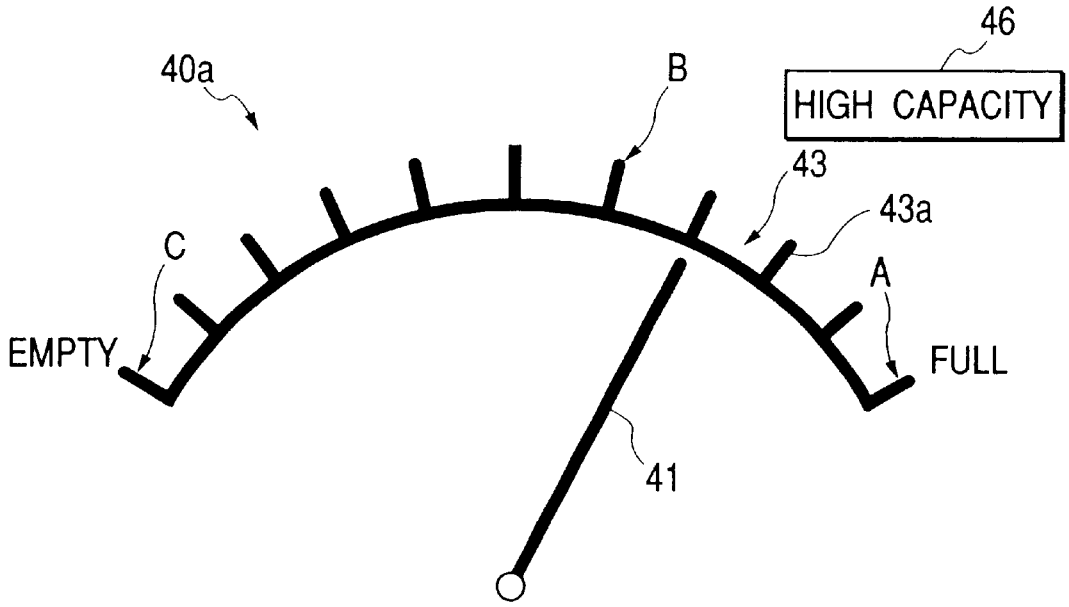
FIGS. 10A and 10B show another embodiment of the developer amount indicating method according to the present invention, FIG. 10A showing a case where the high capacity process cartridge is mounted, and FIG. 10B showing a case where the low capacity process cartridge is mounted.
Figure 10B:
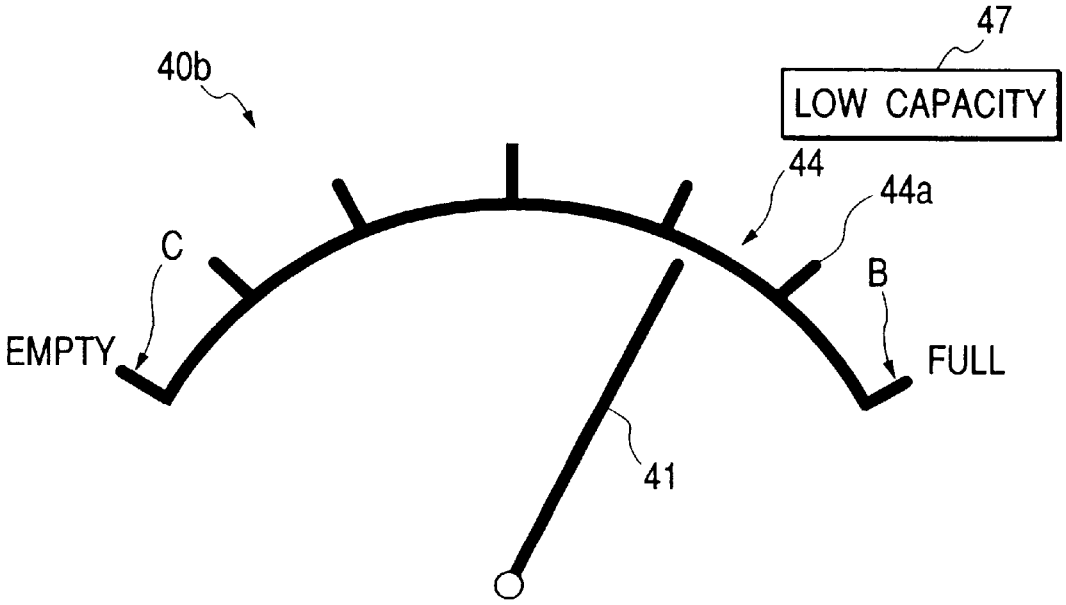

FIGS. 10A and 10B show specific examples of developer remaining amount indications 40*a* and 40*b* in the present embodiment. In the present embodiment, a description will be provided of cases where as a plurality of types of process cartridges 52 differing in the fill amount of developer in the developer container 6, as in Embodiment 1, a high capacity cartridge 52*a*, whose the fill amount of developer in the developer container 6 is 500 g, and a low capacity cartridge 52*b*, whose fill amount of developer in the developer container 6 is 300 g, are mounted in the main body 100 of the image forming apparatus. FIG. 10A shows the developer remaining amount indication 40*a* when the process cartridge 52 mounted in the main body 100 of the image forming apparatus has been discriminated as being the high capacity cartridge 52*a*, and FIG. 10B shows the developer remaining amount indication 40*b* when the process cartridge 52 mounted in the main body 100 of the image forming apparatus has been discriminated as being the low capacity cartridge 52*b*.

As shown in FIGS. 10A and 10B, in a case where the high capacity cartridge 52*a* or the low capacity cartridge 52*b* is mounted in the main body 100 of the image forming apparatus, gauges (indicating portions) 43 and 44 for high capacity and low capacity, respectively, provided with graduations 43*a* and 44*a* from "Full", indicative of the fill amount of developer when the cartridges are new, to "Empty", indicative of the absence of the developer, are indicated. In the present embodiment, the gauges 43 and 44 are divided for 50 g each of developer by the graduations 43*a* and 44*a*, respectively, and the sizes of the wholes of the gauges 43 and 44 are the same. Accordingly, a graduation of the gauge is enlarged and indicated when the low capacity cartridge 52*b* is mounted.

That is, the pointer 41 moves in conformity with the movement of the surface of the upper portion of the developer in the developer container 6. The pointer 41 is controlled as follows by the CPU 32. First, the pointer 41 points to a position A in the gauge 43 for high capacity when the amount of developer is 500 g, and points to positions B in the gauges 43 and 44 for high capacity and low capacity, respectively, when the amount of developer is 300 g. The pointer 41 points to positions C in the gauges 43 and 44 for high capacity and low capacity, respectively, when the developer is absent. As described above, the indication is controlled by the CPU 32 so that the width of the variation of the pointer 41 pointing to the gauges 43 and 44 for high capacity and low capacity, respectively, by the amount of developer may differ depending on the type of the process cartridge 52 mounted in the main body 100 of the image forming apparatus.

By adopting the construction of the present embodiment, in a case where the high capacity cartridge 52*a* is mounted, "Full" in the gauge 43 for high capacity is indicated when the cartridge is new, and the amount of developer can be successively indicated until the developer runs short and the pointer 41 points to the position of "Empty". Also, in a case where the low capacity cartridge 52*b* is mounted, "Full" in the gauge 44 for low capacity is indicated when the cartridge is new, and the amount of developer can be successively indicated until the developer runs short and the pointer 41 points to the position of "Empty".

Further, in order to make it easy for the user to discriminate between the types of the process cartridges 52 being used, as shown in FIGS. 10A and l0B, the type indications 46 and 47 of the process cartridges 52 such as "High Capacity" when the example, the high capacity cartridge 52*a* is mounted, and "Low Capacity" when the low capacity cartridge 52*b* is mounted may be effected. Also, the colors of the gauges may be made to differ between the gauge 43 for high capacity and the gauge 44 for low capacity.

Figure 11A:
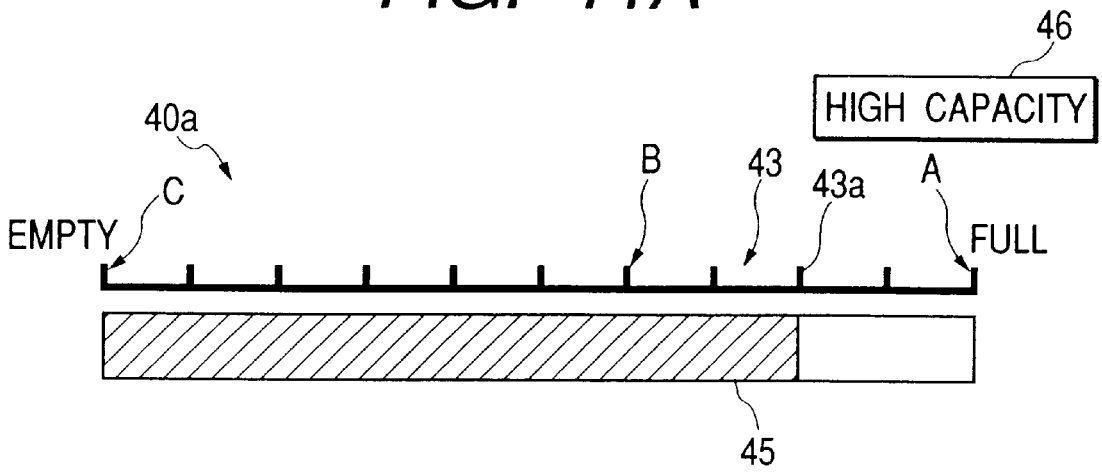
FIGS. 11A and 11B show a modification of the developer amount indicating method shown in FIGS. 10A and 10B, with FIG. 11A showing a case where the high capacity process cartridge is mounted, and FIG. 11B showing a case where the low capacity process cartridge is mounted.
Figure 11B:
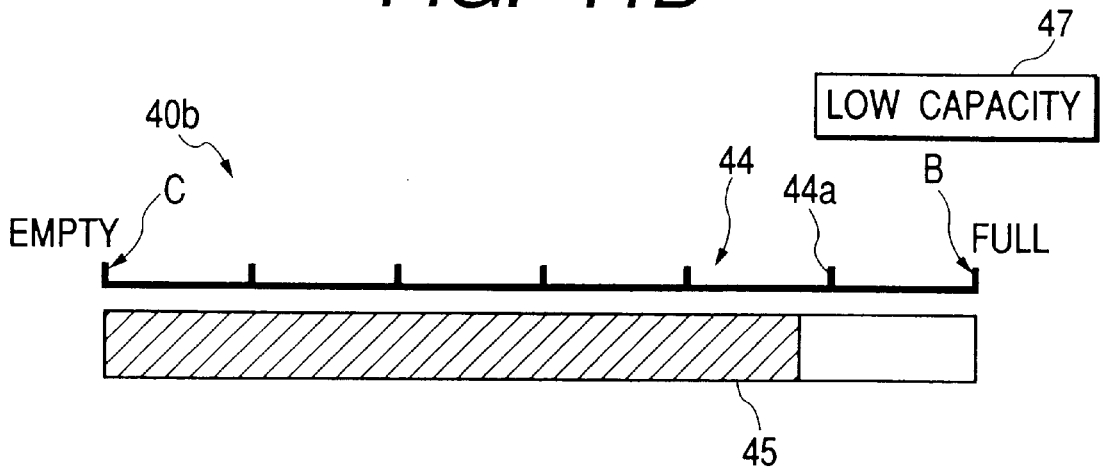

FIGS. 11A and 11B show a modification of the present embodiment. In this modification, instead of the pointers 41 in FIGS. 10A and 10B, bars 45 point to positions in the gauges 43 and 44, and indicate the amounts of developer in the developer containers 6. Again by such an indicating method, an effect similar to that in the case of the indicating method shown in FIGS. 10A and 10B can be obtained.

While in the present embodiment, the discriminating member 23 is provided on the process cartridge 52 and the type detecting means 24 is provided in the main body 100 of the image forming apparatus, and the developer remaining amount indications 40*a* and 40*b* on the developer amount indicating means 33 are automatically changed over, a system, in which a manually operated changeover switch is provided on the main body 100 of the image forming apparatus and the user himself operates the switch to thereby change over the indication, can also be adopted as the type detecting means 24.

As described above, according to the present embodiment, even when the plurality of types of process cartridges 52*a* and 52*b* differing in the fill amount of developer in the developer container 6 are mounted, it is possible to effect the indication of the amount of developer which is comprehensible to the user.

Embodiment 3

The constructions of a process cartridge and an image forming apparatus in this embodiment are similar to those in Embodiment 2 and therefore, members similar in construction and function to those in Embodiment 2 are given similar reference numerals and need not be described in detail.

According to the present embodiment, as in Embodiment 2, the process cartridge 52 has a discriminating member 23 indicative of the type of the process cartridge 52 by the fill amount of developer contained in the developer container 6, i.e., the fill amount when the process cartridge is new. Also, type detecting means 24 is provided in the main body 100 of the image forming apparatus, and this type detecting means 24, in a state in which the process cartridge 52 is mounted in the main body 100 of the image forming apparatus, reads information regarding the type of the process cartridge 52 indicated by the discriminating member 23 provided on the process cartridge 52. In accordance with the information read by the type detecting means 24, the CPU 32 as controlling means changes over the developer remaining amount indications 40*a* and 40*b* as indicating portions automatically indicated on the developer amount indicating means 33 so as to conform to the type of the mounted process cartridge 52.

Further in the present embodiment, even when the developer remaining amount indications 40*a* and 40*b* have been changed over depending on the type of the process cartridge 52 mounted in the main body 100 of the image forming apparatus, the position pointed to by the pointer 41 in conformity with the amount of developer remaining in the process cartridge 52 is made the same, whereby the indication is made easy for the user to confirm the remaining amount of developer.

Figure 12A:
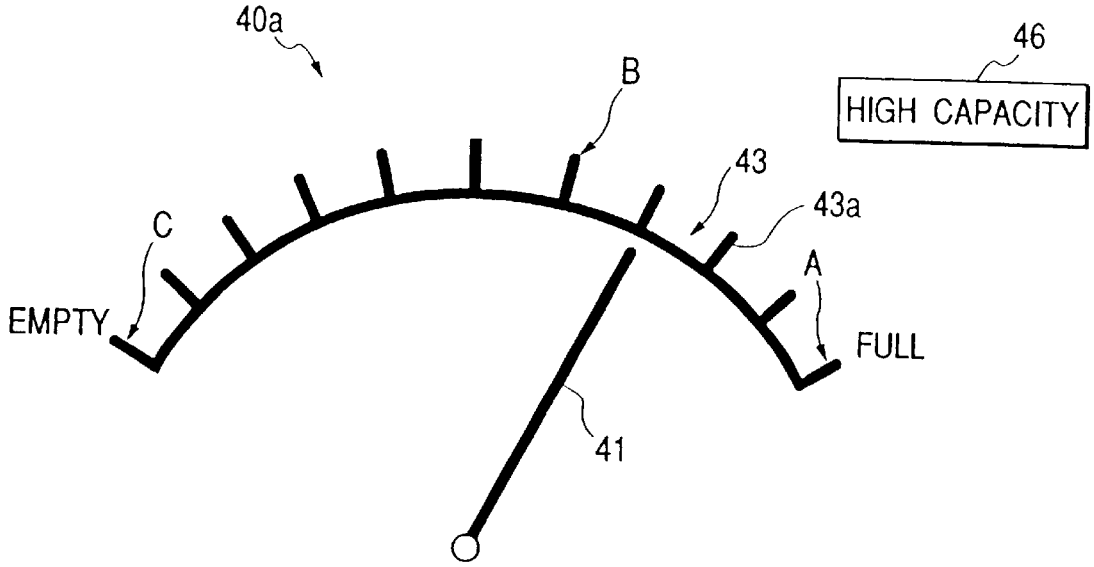
FIGS. 12A and 12B show still another embodiment of the developer amount indicating method according to the present invention, with FIG. 12A showing a case where the high capacity process cartridge is mounted, and FIG. 12B showing a case where the low capacity process cartridge is mounted.
Figure 12B:
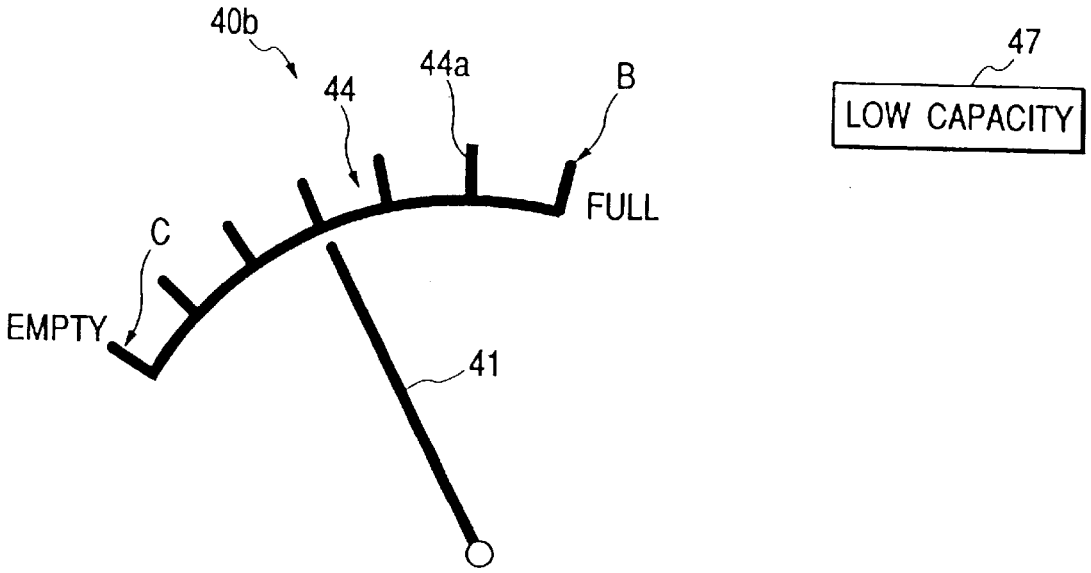

FIGS. 12A and 12B show a specific example of the developer amount indicating method in the present embodiment. In the present embodiment, a description will be provided of cases where as a plurality of types of process cartridges 52, as in Embodiment 2, a high capacity cartridge 52*a,* whose fill amount of developer in the developer container 6 is 500 g, and a low capacity cartridge 52*b,* whose fill amount of developer is 300 g, are mounted in the main body 100 of the image forming apparatus. FIG. 12A shows the developer remaining amount indicatiob 40*a* when the process cartridge 52 mounted in the main body 100 of the image forming apparatus has beem discriminated as being the high capacity cartridge 52*a,* and FIG. 12B shows the developer remaining amount indication 40*b* when the process cartridge 52 mounted in the main body 200 of the image forming apparatus has been discriminated as being the low capacity cartridge 52*b*.

As shown in FIGS. 12A and 12B, in the present embodiment, when the high capacity cartridge 52*a* or the low capacity cartridge 52*b* is mounted in the main body 100 of the image forming apparatus, gauges 43 and 44 for high capacity and low capacity, respectively, provided with graduations 43*a* and 44*a* from "Full", indicative of the amount of developer when the cartridge is new, to "Empty", indicative of the absence of the developer, are indicated, respectively. In the present embodiment, the widths of graduations corresponding to the amounts of decrease in the developer are the same and the positions of "Empty" are the same. Accordingly, the gauge 43 for high capacity and the gauge 44 for low capacity differ in only the position of "Full" from each other.

That is, the pointer 41 moves in conformity with the movement of the surface of the upper portion of the developer in the developer container 6, and points to a position A in the gauge 43 for high capacity when the amount of developer is 500 g, and points to positions B in the gauges 43 and 44 for high capacity and low capacity, respectively, when the amount of developer is 300 g, and points to positions C in the gauges 43 and 44 for high capacity and low capacity, respectively, when the developer is absent. As described above, the CPU 32 discriminates the type of the mounted process cartridge 52, and automatically changes over the developer remaining amount indication 40 so that, irrespective of the discriminated type of the process cartridge 52, the positions pointed to by the pointer 41 may become the same in conformity with the amount of developer.

By adopting the construction of the present embodiment, in a case where the high capacity cartridge 52*a* is mounted, when the cartridge is new, "Full" in the gauge 43 for high capacity is indicated, and the amount of developer can be successively indicated until the developer runs short and the pointer 41 points to the position of "Empty", and also in a case where the low capacity cartridge 52*b* is mounted, when the cartridge is new, "Full" in the gauge 44 for low capacity is indicated, and the amount of developer can be successively indicated until the developer runs short and the pointer 41 points to the position of "Empty".

Further, as in Embodiment 2, in order to make it easy for the user to discriminate the type of the process cartridge 52 being used, as shown in FIGS. 12A and 12B, the type indications 46 and 47 of the process cartridge 52 such as "High Capacity" when the high capacity cartridge 52*a* has been mounted, and "Low Capacity" when the low capacity cartridge 52*b* has been mounted may be effected. Also, the gauge 43 for high capacity and the gauge 44 for low capacity may be made to differ in the color of the gauge from each other.

Figure 13A:
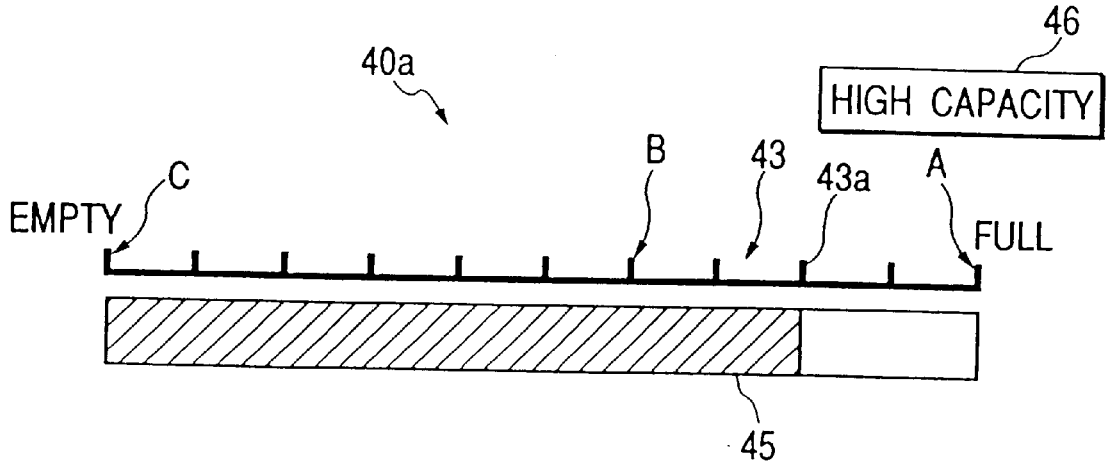
FIGS. 13A and 13B show a modification of the developer amount indicating method shown in FIGS. 12A and 12B, with FIG. 13A showing a case where the high capacity process cartridge is mounted, and FIG. 13B showing a case where the low capacity process cartridge is mounted.
Figure 13B:
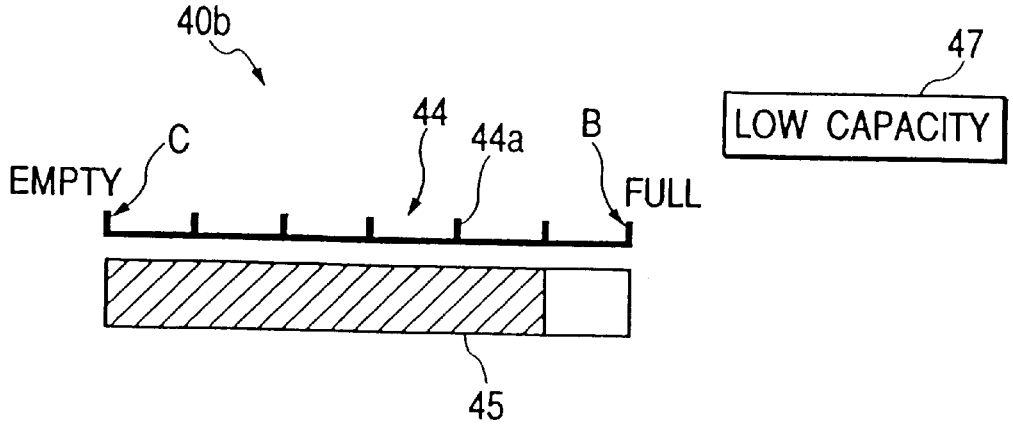

FIGS. 13A and 13B show a modification of the present embodiment. In this modification, instead of the pointers 41 in FIGS. 12A and 12B, bars 45 point to positions in the gauges 43 and 44, and indicate the amounts of developer in the developer containers 6. Again by such an indicating method, an effect similar to that in the case of the indicating method shown in FIGS. 12A and 12B can be obtained.

While as in Embodiment 2, a discriminating member 23 is provided on the process cartridge 52 and type detecting means 24 is provided in the main body 100 of the image forming apparatus and the developer remaining amount indications 40*a* and 40*b* are automatically changed over by the developer amount indicating means 33, a system in which a manually operated changeover switch is provided on the main body 100 of the image forming apparatus and the user himself operates the switch to thereby change over the indication can be adopted as the type detecting means 24.

Also, as in Embodiments 1 and 2, the developer amount indicating means 33 for indicating the developer remaining amount indications 40*a* and 40*b* may be an indicating portion, such as an LCD display, provided on the main body of the image forming apparatus, but for example, in an image forming apparatus connected to a personal computer network, it may be a system in which the developer remaining amount indications 40*a* and 40*b* are indicated on the screen of an outside device, such as the screen of a host computer connected to the image forming apparatus. By doing so, the user can know the remaining amount of developer while operating the host computer.

As described above, according to the present embodiment, even when a plurality of types of process cartridges 52*a* and 52*b* differing in the fill amount of developer in the developer container 6 are mounted, it is possible to effect the indication of the amount of developer which is comprehensible to the user and particularly, the widths of graduations in the graduations 43*a* and 44*b* of the gauges 43 and 44 are equal to one another and therefore, the visual perceptibility of the remaining amount of developer is good even if the types of the process cartridges differ.

Embodiment 4

Figure 14:
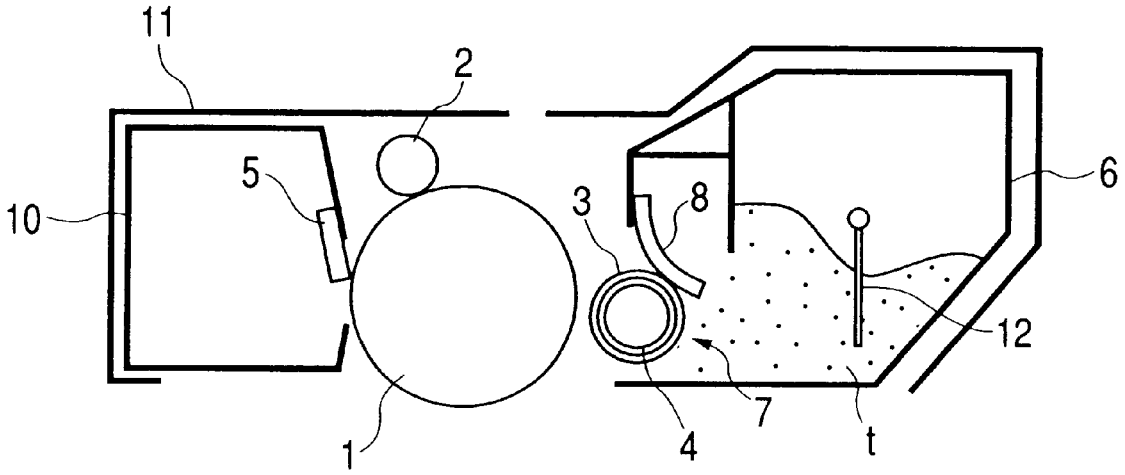
FIG. 14 is a view for illustrating another embodiment of developer amount detecting means according to the present invention.
Figure 15:
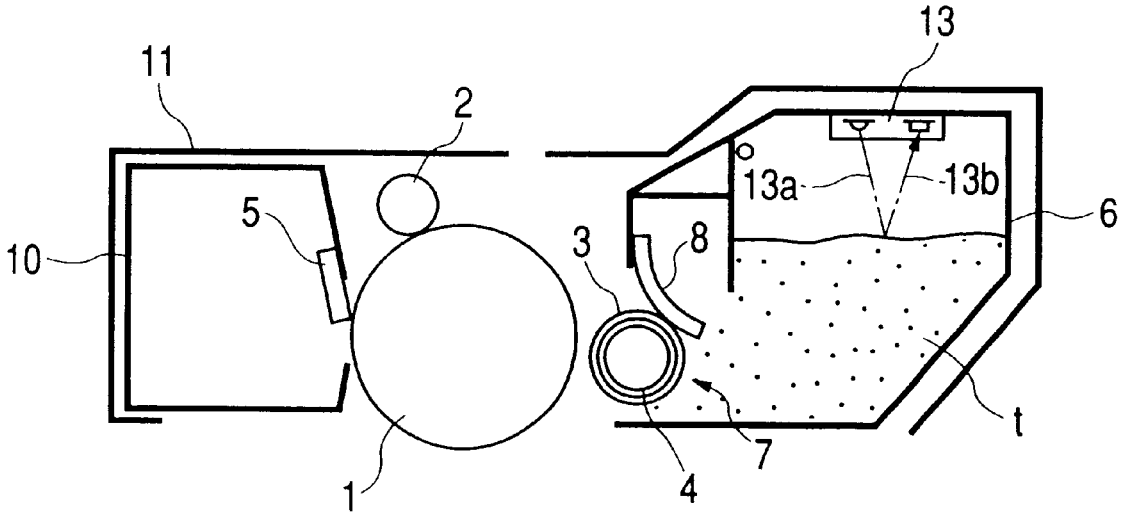
FIG. 15 is a view for illustrating another embodiment of the developer amount detecting means according to the present invention.
Figure 16:
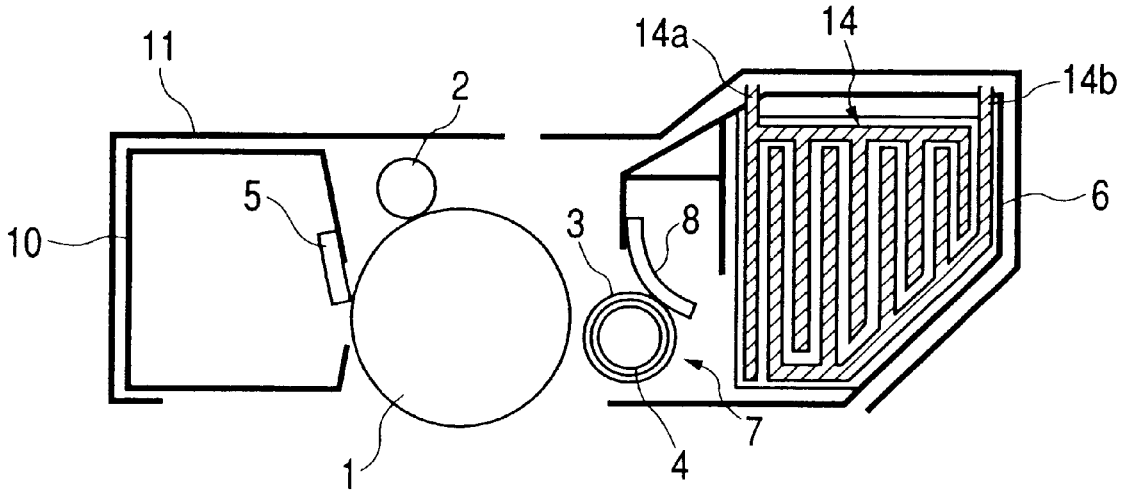
FIG. 16 is a view for illustrating another embodiment of the developer amount detecting means according to the present invention.

In the above-described Embodiments 1 to 3, as the developer amount detecting means 20, use is made of a system in which the position of the contacting means 21, disposed on the surface of the upper portion of the developer in the developer container 6 and moving with the movement of the surface of the upper portion of the developer, is detected by the arm 22, which is following means. As previously described, however, the present invention is not restricted to this system, but as the developer amount detecting means 20 according to the present invention, use can be made of any means that can successively detect the amount of developer remaining in the developer container 6. Specifically, an effect similar to that of the above-described Embodiments 1 to 3 can also be obtained when use is made of any one of the following systems:

(1) a system as shown in FIG. 14 wherein the remaining amount of developer in the developer container 6 is detected by detecting any fluctuation in a force applied to the agitating member 12 for agitating and carrying the developer in the developer container 6, or any fluctuation in torque when the developer is agitated and carried by rotation;

(2) a system in which the light emitting time of the exposing means, i.e., a laser or an LED, for forming an electrostatic latent image on the photosensitive drum 1, is accumulated to thereby presume the consumed amount of developer, and the amount of developer is detected from the result;

(3) a system in which the amount of developer is detected from the weight of developer remaining in the developer container 6;

(4) a system as shown in FIG. 15 wherein detecting light 13*a* is applied from a light emitting and receiving element 13 installed, for example, on the upper portion of the developer container 6, to the surface of the developer, and the wavelength, the response time, the angle of incidence, and the distance of travel in a substantially vertical direction of the reflected light 13*b* thereof are measured to thereby optically detect the position of the surface of the upper portion of the developer, or a system in which when a sound wave is used instead of detecting light, the height of the surface of the developer is measured from the frequency or the like of the reflected sound wave to thereby detect the remaining amount of developer;

(5) a system in which a coil is disposed in the developer container 6 and the remaining amount of developer is detected by the utilization of the fact that magnetic penetrability differs depending on the amount of developer passing through this coil;

(6) a system as shown in FIG. 16 wherein a measuring electrode member 14, provided with an input side electrode 14*a* and an output side electrode 14*b* having at least a pair of portions juxtaposed at a predetermined interval, is provided on such a portion that contacts the developer in the developer container 6 and the area of contact, which, with the developer, changes with a decrease in the amount of developer, for example, the inner side of the developer container 6, and a voltage is applied between the electrodes 14*a* and 14*b* from voltage applying means (not shown) provided in the main body 100 of the image forming apparatus through the input side electrode 14*a*, and the electrostatic capacity of the measuring electrode member 14, changed by the consumption of the developer through the output side electrode 14*b*, is detected by the controlling portion 30 provided in the main body 100 of the image forming apparatus to thereby detect the amount of developer; and (7) a system having the means described in Embodiments 1 to 3 and a plurality of means described in items (1) to (6) above as the developer amount detecting means 20 to thereby successively detect the remaining amount of developer.

Figure 17:
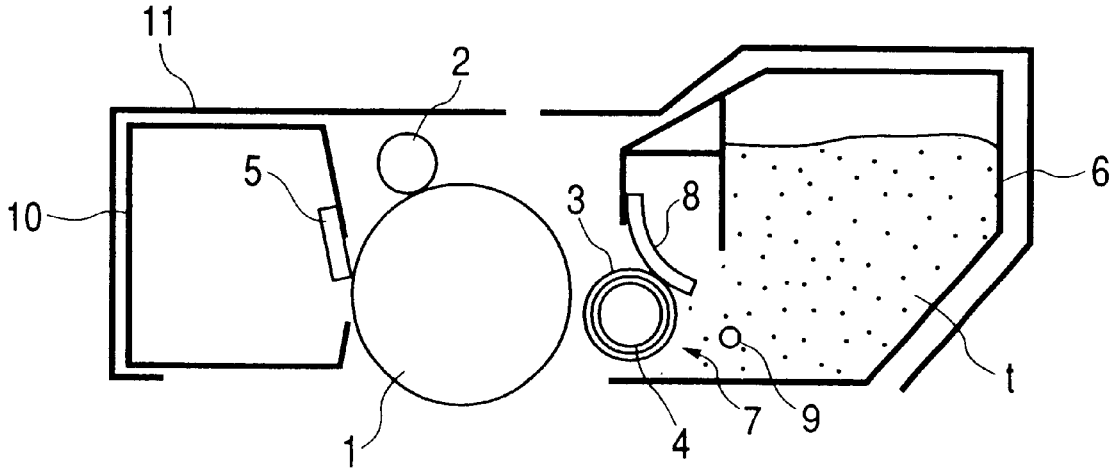
FIG. 17 is a view for illustrating end detecting means for the developer which can be provided in a developer container in accordance with the present invention.
Figure 18:
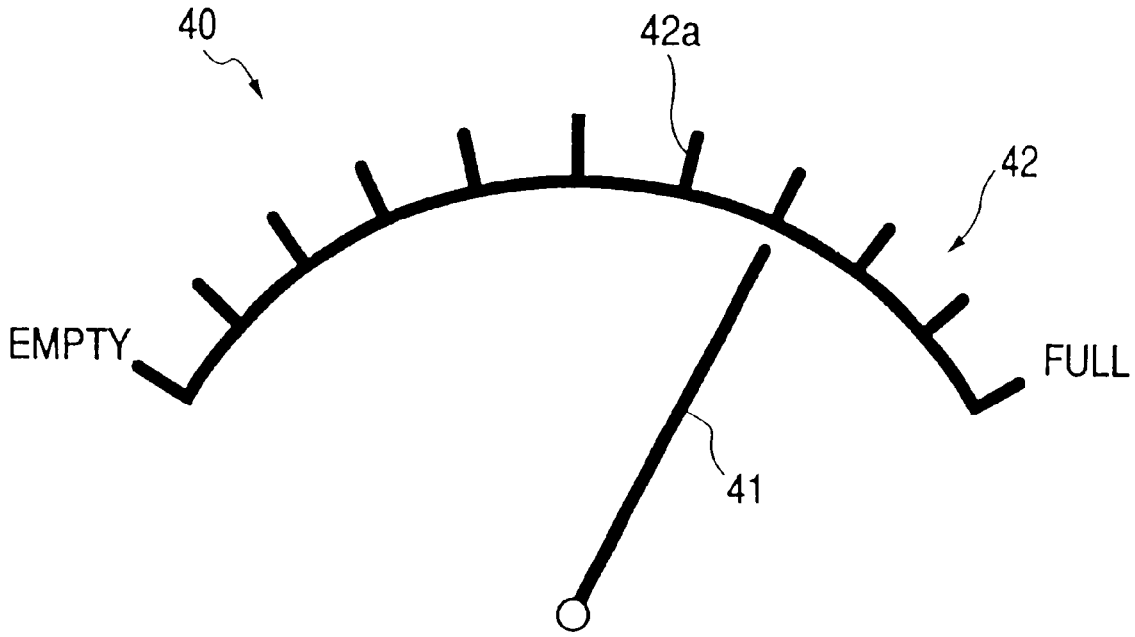
FIG. 18 PRIOR ART
FIG. 18 shows an example of the developer amount indicating method according to the conventional art.

Also, as has hitherto been described, provision is made of the developer amount detecting means 20 for successively detecting the amount of developer in the developer container 6, but more preferably, as shown in FIG. 17, an antenna rod, i.e., an electrode rod 9, as developer end detecting means extending by a predetermined length in the lengthwise direction of the developing sleeve 3 of the developing means 7 at a predetermined interval from the developing sleeve 3, is further provided outside the developer amount detecting means 20, and any change in the electrostatic capacity between the developing sleeve 3 and the electrode rod 9 can be detected to thereby detect the end of the developer.

The aforedescribed embodiments are summarized as follows.

In a developer amount successively indicating method used in an electrophotographic image forming apparatus (P) capable of detachably mounting a plurality of types of cartridges (e.g. process cartrdiges 51*a*, 51*b*) differing in the fill amount of developer (t), an indicating portion (gauges 43, 44, developer amount indication 40) selected in conformity with the type of one of the plurality of types of cartridges, which is mounted in the main body (100) of the electrophotographic image forming apparatus (P), is indicated, and the detected amount of developer in the cartridge mounted in the main body (100) of the electrophotographic image forming apparatus is successively indicated by the use of the indicating portion.

Also, another developer amount successively indicating method is as follows.

In a developer amount successively indicating method used in a electrophotographic image forming apparatus capable of detachably mounting a plurality of types of cartridges differing in the fill amount of developer (t), indicating portions conforming to the types of the cartridges are indicated correspondingly to the types, and the detected amount of developer in the cartridge mounted in the main body of the electrophotographic image forming apparatus is successively indicated by the use of the indicated indicating portions.

Here, the indicating portions (gauges 43, 44, developer amount indication 40) have graduations (43*a*, 44*a*), and in the graduations (43*a,* 44*a*), a graduation indicates the same amount of developer, irrespective of the types of the cartridges (e.g. process cartridges 51*a,* 51*b*), and the intervals between adjacent ones of the graduations are equal.

Also, the indicating portions (gauges 43, 44, developer amount indication 40) differ in indicating color in conformity with the types of the cartridges.

The indicating portions (gauges 43, 44, developer amount indication 40) have developer amount indicating areas from "Full" to "Empty", and the indicating method successively indicates the detected amount of developer in the cartridge mounted in the main body of the electrophotographic image forming apparatus from "Full" to "Empty".

Also, the indicating portions (gauges 43, 44, developer amount indication 40) are indicated on the main body (100) of the electrophotographic image forming apparatus.

Or the indicating portions (gauges 43, 44, developer amount indication 40) are indicated on the display of a host computer connected to the main body (100) of the electrophotographic image forming apparatus.

Further, in addition to the indicating portions (gauges 43, 44, developer amount indication 40), the type of the cartridge (51*a,* 51*b*) mounted in the main body (100) of the electrophotographic image forming apparatus is indicated.

The cartridge is a process cartridge (51*a,* 51*b*) integrally having a developer supplying container (not shown) containing therein a developer to be supplied to the main body (100) of the electrophotographic image forming apparatus, or an electrophotographic photosensitive member (1) and process means (at least one of charging means 2, cleaning means 5 and developing means 7) acting on the electrophotographic photosensitive member, and detachably mountable in the main body (100) of the electrophotographic image forming apparatus.

As previously described, the process means is at least one of the developing means 7 for developing the electrostatic latent image formed on the electrophotographic photosensitive member (1), the charging means (2) for charging the electrophotographic photosensitive member (1), and the cleaning means (5) for removing any developer residual on the electrophotographic photosensitive member (1).

Also, an informing portion (discriminating member 23) each cartridge has in conformity with its type is detected by a detecting portion (type detecting means 24) which the main body (100) of the electrophotographic image forming apparatus has. The indicating portions are selected and indicated on the basis of the result of the detection.

Also, the construction of the aforedescribed electrophotographic image forming apparatus is as follows.

An electrophotographic image forming apparatus (P) for forming an image on a recording medium (S), which is capable of detachably mounting a cartridge (e.g. process cartridge 51*a,* 51*b*) having a developer containing portion (developer container 6) containing therein a developer (t) to be used to develop an electrostatic latent image formed on an electrophotographic photosensitive member (1), has:

(a) a mounting portion (mounting means 112) for detachably mounting in the main body (100) of the electrophotographic image forming apparatus (P) a plurality of types of cartridges differing in the fill amount of the developer filling the developer containing portion, each of the cartridges having a detecting signal outputting portion (developer amount detecting means 20) for outputting a detecting signal for successively detecting the remaining amount of the developer (t) contained in the developer containing portion, and an informing portion (discriminating member 23) for informing the main body of the apparatus of the types of the cartridges; and (b) controlling means (CPU 32) for selecting an indicating portion (gauges 43, 44, developer amount indication 40) in conformity with the type of the cartridge mounted in the main body (100) of the electrophotographic image forming apparatus (P), on the basis of the information from the informing portion (discriminating member 23) of the cartridge mounted on the mounting portion (mounting means 112), and successively indicating the remaining amount of the developer (t) by the use of the selected indicating portion on the basis of the detecting signal produced from the detecting signal outputting portion (developer amount detecting means 20).

Also, the construction of another electrophotographic image forming apparatus is as follows.

An electrophotographic image forming apparatus for forming an image on a recording medium (S) which is capable of detachably mounting a cartridge (e.g. process cartridge 51*a,* 51*b*) having a developer containing portion (developer container 6) containing therein a developer (t) to be used to develop an electrostatic latent image formed on an electrophotographic photosensitive member (1) has:

(a) a mounting portion (mounting means 112) for detachably mounting in the main body (100) of the electrophotographic image forming apparatus (P) a plurality of types of cartridges differing in the fill amount of the developer filling the developer containing portion, each of the cartridges having a detecting signal outputting portion (developer amount detecting means) for outputting a detecting signal for successively detecting the remaining amount of the developer (t) contained in the developer containing portion; and (b) controlling means (CPU 32) for indicating indicating portions (gauges 43, 44, developer amount indication 40) conforming to the types of the cartridges correspondingly to the types, and successively indicating the detected amount of developer in the cartridge mounted on the mounting portion, by the use of the indicated indicating portions, on the basis of the detecting signal produced from the detecting signal outputting portion.

Also, the construction of the process cartridge is as follows.

A process cartridge (51*a,* 51*b*) detachably mountable in the main body of an electrophotographic image forming apparatus has:

an electrophotographic photosensitive member (1);

developing means (7) for developing an electrostatic latent image formed on the electrophotographic photosensitive member (1);

a developer containing portion (developer container) containing therein a developer (t) to be used for the development of the electrostatic latent image in the developing means (7);

a detecting signal outputting portion (developer amount detecting means 20) for outputting a detecting signal for successively detecting the remaining amount of the developer contained in the developer containing portion in the main body (100) of the electrophotographic image forming apparatus; and an informing portion (discriminating member 23) for informing the main body (100) of the apparatus of the type of the cartridge.

In each of the above-described embodiments, the term "Full" indicates an amount corresponding to the initial fill amount of the developer in the developer container 6, or an amount intended as the initial fill amount, i.e., a maximum amount detectable by the developer amount detecting means 20, and the indication itself is not restricted thereto.

Accordingly, as a matter of course, it is also possible to indicate, for example, numerical values indicative of the amounts of developer, percentages representative of the use rates, etc., on the gauges.

Further, while in each of the above-described embodiments, the term "Full" has been described as indicating the initial fill amount of the developer in the developer container 6, and it has been described that the amount of developer is successively indicated over the entire area from "Full" to "Empty", the present invention is not restricted thereto. For example, even in a case where there is adopted such a construction in which from a point of time at which a half of the developer in the developer container has been used to "Empty" is indicated, by applying the embodiments described in Embodiments 2 and 3, it is possible to automatically change over the developer amount indication in an image forming apparatus capable of mounting a plurality of types of process cartridges differing in the initial fill amount of the developer so as not to confuse the user. That is, with 100% as the fill amount of the developer contained in the developer container, the present invention is not restricted to successively detecting the amount of developer over the entire area of 100% to 0%, but the design may be made such that the amount of developer is successively detected, for example, over an area of 50% to 0% (Empty).

Also, in each of the above-described embodiments, the term "Empty" indicates the detectable minimum amount of the developer in the developer container 6, i.e., such an amount that the developer container 6 is substantially empty, and includes also a state in which the developer is present in the developer container 6, but the amount of developer is small to such a degree that may spoil image dignity (development dignity). The present invention does not restrict the indication itself thereto, but as a matter of course, it is also possible to indicate, for example, numerical values indicative of the amounts of developer, percentages representative of the use rates, etc. on the gauges.

As described above, according to the aforedescribed embodiments, even when a plurality of types of process cartridges differing in the fill amount of the developer with respect to the developer container are mounted, it is possible to effect the indication of the amount of developer which is comprehensible to the user. Particularly, in all of a plurality of types of process cartridges differing in the initial amount of developer filling the developer container, the remaining amount of developer can be successively indicated from "Full" to "Empty".

As described above, according to the present invention, there can be provided a developer amount indicating method, an electrophotographic image forming apparatus and a process cartridge which can comprehensibly indicate the amount of developer.

Also, according to the present invention, in an image forming apparatus capable of mounting a plurality of types of process cartridges differing in the fill amount of developer with respect to a developer containing portion, there can be provided a developer amount indicating method which can successively indicate the amount of developer in conformity with the types of the process cartridges, an electrophotographic image forming apparatus using the indicating method, and a process cartridge detachably mountable in the main body of the image forming apparatus.

While the invention has been described with reference to structures disclosed herein, it is not confined to the details set forth and this application is intended to cover such modifications or changes as may come within the purposes of the improvements or the scope of the following claims.

What is claimed is:

1. A developer amount succesively indicating method used in an electrophotographic image forming apparatys detachably mounting a plurality of types of process cartridges differing in a fill amount of a developer, said method comprising:

indicating an indicating selected in corformity with a type of one of said plurality of types of cartridges which is mounted in a main body of said electrophotographic image forming apparatus; and successively indicating a detected amount of developer in the cartridge mounted in the main body of said electrophotographic image forming apparatus, by use of said indicating portion.

2. A developer amount successively indicating method according to claim 1, wherein an informing portion of each of said cartridges has in conformity with its type is detected by a detecting portion the main body of said electrophotographic image forming apparatus has, and said indicating portion is selected and indicated based on a result of detection.

3. A developer amount successively indicating method according to claim 1 or 2, wherein said indicating portion has graduations, and in said graduations, a graduation indicates a same amount of developer, irrespective of the types of the cartridges, and intervals between adjacent ones of the graduations are equal.

4. A developer amount successively indicating method according to claims 1 or 2, wherein said indicating portion differs indicating color in conformity with the types of the cartridges.

5. A developer amount successively indicating method according to claims 1 or 2, wherein said indicating portion has developer amount indicating ares from "Full" to "Empty", and said indicating method successively indicates the detected amount of developer in the cartridge mounted in the main body of said electrophotographic image forming apparatus from "Full" to "Empty".

6. A developer amount successively indicating method according to claim 1, wherein said indicating portion is indicated on the main body of said electrophotographic image forming apparatus.

7. A developer amount successively indicating method according to claim 1, wherein said indicating portion is indicated on a display of a host computer connected to the main body of said electrophotographic image forming apparatus.

8. A developer amount successively indicating method according to any one of claims 1, 2, 6 or 7, wherein in addition to said indicating portion, the type of the cartridge mounted in the main body of said electrophotographic image forming apparatus is indicated.

9. A developer amount successively indicating method according to claim 1, wherein each of said cartridges is a process cartridge integrally having a developer supplying container containing therein a developer to be supplied to the main body of said electrophotographic image forming apparatus, or an electrophotographic photosenstive member and process means acting on said electrophotographic photosensitive member, and detachably mountable in the main body of said electrophotographic image forming apparatus.

10. A developer amount successively indicating method according to claim 9, wherein said process means is at least one of developing means for developing an electrostatic latent image formed on said electrographic photosensitive member, charging means for charging said electrographic photosensitive member, and cleaning means for removing any developer residual on said electrographic photosensitive member.

11. A developer amount successively indicating method used in an electrophotographic image forming apparatus detachably mounting a plurality of types of cartridges differing in a fill amount of developer, said method comprising:

indicating indicating portions conforming to the types of said cartridges correspondingly to said types; and successively indicating a detected amount of developer in the cartridge mounted in the main body of said electrophotographic image forming apparatus, by use of indicated indicating portions.

12. A developer amount successively indicating method according to claim 11, wherein said indicating portions have graduations, and in said graduations, a graduation indicates a same amount of developer, irrespective of the types of the cartridges, and intervals between adjacent ones of the graduations are equal.

13. A developer amount successively indicating method according to claim 11 or 12, wherein said indicating portions differ in indicating color in conformity with the types of the cartridges.

14. A developer amount successively indicating method according to claims 11 or 12, wherein said indicating portions have developer amount indicating area from "Full" to "Empty", and said indicating method successively indicates the detected amount of developer in the cartridge mounted in the main body of said electrophotographic image forming apparatus from "Full" to "Empty".

15. A developer amount successively indicating method according to claim 11, wherein said indicating portions are indicated on the main body of said electrophotographic image forming apparatus.

16. A developer amount successively indicating method according to claim 11, wherein said indicating portions are indicated on a display of a host computer connected to the main body of said electrophotographic image forming apparatus.

17. A developer amount successively indicating method according to claim 11, wherein each of said cartridges is a process cartridge integrally having a developer supplying container containing therein a developer to be supplied to the main body of said electrophotographic image forming apparatus, or an electrophotographic photosensitive member and process means acting on said electrophotographic photosensitive member, and detachably mountable in the main body of said electrophotographic image forming apparatus.

18. A developer amount successively indicating method according to claim 17, wherein said process means is at least one of developing means for developing an electrostatic latent image formed on said electrophotographic photosensitive member, charging means for charging said electrophotographic photosensitive member, and cleaning means for removing any developer residual on said electrophotographic photosensitive member.

19. An electrophotographic image forming apparatus for forming an image on a recording medium, said electrophotographic image forming apparatus detachably mounting a cartridge having a developer containing portion containing therein a developer to be used to develop an electrostatic latent image formed on an electrophotographic photosensitive member, said electrophotographic image forming apparatus comprising:

(a) a mounting portion for detachably mounting in a main body of said electrophotographic image forming apparatus a plurality of types of cartridges differing in a fill amount of the developer filling said developer containing portion, each of the cartridges having a detecting signal outputting portion for outputting a detecting signal for successively detecting a remaining amount of the developer contained in said developer containing portion, and an informing portion for informing the main body of said apparatus of the types of said cartridges; and (b) controlling means for selecting an indicating portion in conformity with the type of the cartridge mounted in the main body of said electrophotographic image forming apparatus, based on information from said informing portion of the cartridge mounted on said mounting portion, and successively indicating the remaining amount of said developer by use of the selected indicating portion based on the detecting signal produced from said detecting signal outputting portion.

20. An electrophotographic image forming apparatus according to claim 19, wherein said indicating portion has graduations, and in said graduations, a graduation indicates a same amount of developer, irrespective of the types of the cartridges, and intervals between adjacent ones of the graduations are equal.

21. An electrophotographic image forming apparatus according to claim 19 or 20, wherein said indicating portion differs in indicating color in conformity with the types of the cartridges.

22. An electrophotographic image forming apparatus according to claims 19 or 20, wherein said indicating portion has developer amount indicating areas from "Full" to "Empty", and said controlling means successively indicates the detected amount of developer in the cartridge mounted in the main body of said electrophotographic image forming apparatus from "Full" to "Empty".

23. An electrophotographic image forming apparatus according to claim 19, wherein said indicating portion is indicated on the main body of said electrophotographic image forming apparatus.

24. An electrophotographic image forming apparatus according to claim 19, wherein said indicating portion is indicated on a display of a host computer connected to the main body of said electrophotographic image forming apparatus.

25. An electrophotographic image forming apparatus according to any one of claims 19, 20, 23 or 24, wherein in addition to said indicating portion, the type of the cartridge mounted in the main body of said electrophotographic image forming apparatus is indicated.

26. An electrophotographic image forming apparatus according to claim 19, wherein each of said cartridges is a process cartridge integrally having a developer supplying container containing therein a developer to be supplied to the main body of said electrophotographic image forming apparatus, or the electrophotographic photosensitive member and process means acting on said electrophotographic photosensitive member, and detachably mountable in the main body of said electrophotographic image forming apparatus.

27. An electrophotographic image forming apparatus according to claim 26, wherein said process means is at least one of developing means for developing the electrostatic latent image formed on said electrophotographic photosensitive member, charging means for charging said electrophotographic photosensitive member, and cleaning means for removing any developer residual on said electrophotographic photosensitive member.

28. An electrophotographic image forming apparatus for forming an image on a recording medium, said electrophotographic image forming apparatus detachably mounting a cartridge having a developer containing portion containing therein a developer to be used to develop an electrostatic latent image formed on an electrophotographic photosensitive member, said electrophotographic image forming apparatus comprising:

(a) a mounting portion for detachably mounting in a main body of said electrophotographic image forming apparatus a plurality of types of cartridges differing in a fill amount of the developer filling said developer filling said developer containing portion, each of the cartridges having detecting signal outputting portion for outputting a detecting signal for successively detecting remaining amount of the developer contained in said developer containing portion; and (b) controlling means for indicating portions confirming to the types of said cartridges correspondingly to said types, and successively indicating a detected amount of developer in the cartridge mounted on said mounting portion, by use of indicated indicating portions, based on the detecting signal produced from said detecting signal outputting portion.

29. An electrophotographic image forming apparatus according to claim 28, wherein said indicating portions have graduations, and in said graduations, a graduation indicates a same amount of developer, irrespective of the types of the cartridges, and intervals between adjacent ones of the graduations are equal.

30. An electrophotographic image forming apparatus according to claim 28 or 29, wherein said indicating portions differ in indicating color in conformity with the types of the cartridges.

31. An electrophotographic image forming apparatus according to claims 28 or 29, wherein said indicating portions have developer amount indicating areas from "Full" to "Empty", and said controlling means successively indicates the detected amount of developer in the cartridge mounted in the main body of said electrophotographic image forming apparatus from "Full" to "Empty".

32. An electrophotographic image forming apparatus according to claim 28, wherein said indicating portions are indicated on the main body of said electrophotographic image forming apparatus.

33. An electrophotographic image forming apparatus according to claim 28, wherein said indicating portions are indicated on a display of a host computer connected to the main body of said electrophotographic image forming apparatus.

34. An electrophotographic image forming apparatus according to claim 28, wherein each of said cartridges is a process cartridge integrally having a developer supplying container therein a developer to be supplied to the main body of said electrophotographic image forming apparatus, or the electrophotographic photosensitive member and process means acting on said electrophotographic photosensitive member, and detachably mountable in the main body of said electrophotographic image forming apparatus.

35. An electrophotographic image forming apparatus according to claim 34, wherein said process means is at least one of developing means for developing the electrostatic latent image formed on said electrophotographic photosensitive member, charging means for charging said electrophotographic photosensitive member, and cleaning means for removing any developer residual on said electrophotographic photosensitive member.

36. A process cartridge detachably mountable in a main body of an electrophotographic image forming apparatus, said process cartridge comprising:

an electrophotographic photosensitive member;

developing means for developing an electrostatic latent image formed on said electrophotographic photosensitive member;

a developer containing portion, wherein when said developer containing portion contains developer, the developer is used for a development of said electrostatic latent image in said developing means;

a detecting signal outputting portion for outputting a detecting signal for successively detecting a remaining amount of the developer contained in said developer containing portion in the main body of said electrophotographic image forming apparatus; and an informing portion for informing the main body of said apparatus of a type of said process cartridge, wherein the type of said process cartridge informed of by said informing portion differs in a fill amount of the developer filling said developer containing portion.

37. A process cartridge according to claim 36, wherein said process cartridge has a developer in said developer containing portion.

* * * * *

UNITED STATES PATENT AND TRADEMARK OFFICE

CERTIFICATE OF CORRECTION

PATENT NO. : 6,330,402 B1 
DATED : December 11, 2001
INVENTOR(S) : Kazushige Sakurai et al.

It is certified that error appears in the above-identified patent and that said Letters Patent is hereby corrected as shown below:

Column 9,
Line 62, "the" (1st occurrence) should be deleted.

Column 11,
Line 58, "indicatiob" should read -- indication --.

Column 18,
Line 2, "succesively" should read -- successively --.
Line 3, "apparatys" should read -- apparatus --.
Line 7, "indicating" (2nd occurrence) should read -- indicating portion --, and "corformity" should read -- conformity --.
Line 29, "differs" should read -- differs in --.
Line 33, "ares" should read -- areas --.
Lines 64, 65 and 67, "electrographic" should read -- electrophotographic --.

Column 19,
Line 23, "ares" should read -- areas --.

Column 21,
Line 8, "filling" (2nd occurrence) should be deleted.
Line 9, "said developer" should be deleted.
Line 10, "detecting" should read -- a detecting --.
Line 14, "confirming" should read -- conforming --.

Column 22,
Line 4, "container" should read -- container containing --.
Line 40, "claim 36," should read -- claim 36, further comprising said developer, --.
Line 41, "said process cartridge has a developer in" should be deleted.
Line 42, "portion." should read -- portion contains said developer. --.

Signed and Sealed this

Nineteenth Day of November, 2002

*Attest:*

*Attesting Officer*

JAMES E. ROGAN
*Director of the United States Patent and Trademark Office*